US011261820B2

(12) United States Patent
Ishikawa

(10) Patent No.: US 11,261,820 B2
(45) Date of Patent: Mar. 1, 2022

(54) FUEL INJECTION SYSTEM AND CONTROLLER FOR FUEL INJECTION SYSTEM

(71) Applicant: DENSO CORPORATION, Kariya (JP)

(72) Inventor: Tamaki Ishikawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 41 days.

(21) Appl. No.: 16/936,753

(22) Filed: Jul. 23, 2020

(65) Prior Publication Data

US 2021/0033043 A1 Feb. 4, 2021

(30) Foreign Application Priority Data

Jul. 30, 2019 (JP) ..... JP2019-140283

(51) Int. Cl.

| | |
|---|---|
| ***F01M 9/00*** | (2006.01) |
| ***F02D 41/38*** | (2006.01) |
| ***F02D 41/06*** | (2006.01) |
| ***F02M 59/36*** | (2006.01) |
| ***F02M 59/44*** | (2006.01) |
| ***F02M 59/10*** | (2006.01) |
| ***F02M 63/02*** | (2006.01) |
| *F01M 9/10* | (2006.01) |

(52) U.S. Cl.

CPC ..... *F02D 41/3863* (2013.01); *F02D 41/062* (2013.01); *F02M 59/102* (2013.01); *F02M 59/36* (2013.01); *F02M 59/447* (2013.01); *F02M 63/025* (2013.01); *F01M 9/104* (2013.01); *F02D 2200/0602* (2013.01); *F02D 2200/101* (2013.01); *F02D 2250/31* (2013.01)

(58) Field of Classification Search

CPC ... F01M 9/104; F02D 41/3863; F02D 41/062; F02D 2200/0602; F02D 2200/101; F02D 2250/31; F02M 59/102; F02M 59/36; F02M 59/447; F02M 63/025

See application file for complete search history.

(56) References Cited

U.S. PATENT DOCUMENTS 4,709,667 A * 12/1987 Ichihara ..... F01L 1/053 123/90.27
4,745,889 A * 5/1988 Speil ..... F01L 1/25 123/90.55

(Continued)

FOREIGN PATENT DOCUMENTS

| | | |
|---|---|---|
| EP | 2492480 | 8/2012 |
| JP | 2010-24849 | 2/2010 |

(Continued)

*Primary Examiner* — Gonzalo Laguarda
(74) *Attorney, Agent, or Firm* — Nixon & Vanderhye P.C.

(57) ABSTRACT

A fuel pump includes a camshaft that rotates in accordance with operation of an engine and a tappet provided in contact the camshaft. An ECU includes an angle determination unit configured to determine whether a rotation angle from a start of rotation of the camshaft when starting the engine is under a predetermined angle required for forming an oil film on a sliding portion of the tappet, and a control unit configured to, when the rotation angle from the start of rotation of the camshaft is determined to be under the predetermined angle, execute a limit process including at least one of limiting a fuel discharge pressure of the fuel pump or limiting a rotation of the camshaft.

8 Claims, 12 Drawing Sheets

(56) References Cited

U.S. PATENT DOCUMENTS

| | | | | |
|---|---|---|---|---|
| 5,816,207 | A * | 10/1998 | Kadokawa | F01L 1/18<br>123/90.42 |
| 2002/0117020 | A1 * | 8/2002 | Novak | F01M 9/102<br>74/567 |

FOREIGN PATENT DOCUMENTS

| | | |
|---|---|---|
| JP | 5131265 | 1/2013 |
| JP | 5464649 | 4/2014 |

* cited by examiner

FUEL INJECTION SYSTEM AND CONTROLLER FOR FUEL INJECTION SYSTEM

CROSS REFERENCE TO RELATED APPLICATION

The present application claims the benefit of priority from Japanese Patent Application No. 2019-140283 filed on Jul. 30, 2019. The entire disclosure of the above application is incorporated herein by reference.

TECHNICAL FIELD

The present disclosure relates to a fuel injection system as well as a controller for a fuel injection system.

BACKGROUND

Conventionally, as a fuel injection system, a system is used in which high pressure fuel discharged from a fuel pump is stored in a common rail, and the high pressure fuel in the common rail is injected into a combustion chamber of an internal combustion engine by a fuel injection valve. Further, in such a fuel injection system, lubricating oil forms an oil film on a sliding portion of a tappet in the fuel pump, and the oil film prevents damage such as those caused by seizure or galling.

SUMMARY

In one aspect of the present disclosure, a controller is applied to a fuel injection system including a fuel pump having a camshaft that rotates in accordance with operation of an internal combustion engine, a tappet provided in contact with a cam of the camshaft that converts the rotation of the camshaft into linear motion, and a plunger that reciprocates according to the linear motion of the tappet, the fuel pump being configured to suck and discharge fuel according to the reciprocation of the plunger, an accumulator that stores high pressure fuel discharged from the fuel pump, and a fuel injection valve that injects the high pressure fuel stored in the accumulator into a combustion chamber of the internal combustion engine, the controller including an angle determination unit configured to determine whether a rotation angle from a start of rotation of the camshaft when starting the internal combustion engine is under a predetermined angle required for forming an oil film on a sliding portion of the tappet, and a control unit configured to: when the rotation angle from the start of rotation of the camshaft is determined to be under the predetermined angle, execute a limit process including at least one of limiting a fuel discharge pressure of the fuel pump or limiting a rotation of the camshaft, and when the rotation angle is determined to have exceeded the predetermined angle after having executed the limit process, cancel the limit process execution.

DETAILED DESCRIPTION

Figure 1:
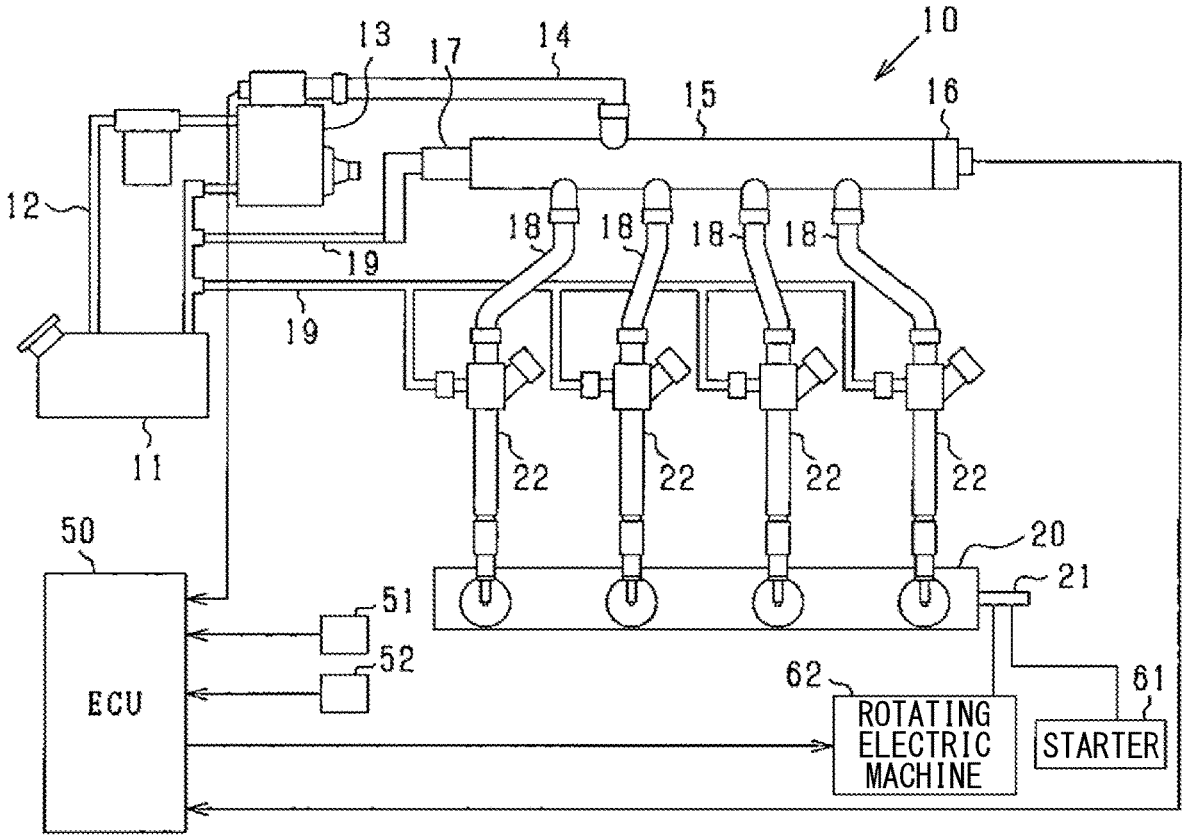
FIG. 1 is a schematic configuration diagram showing the entire fuel injection system.

Embodiments will be described below with reference to the drawings. In the present embodiment, a high pressure fuel injection system includes a common rail that acts as a pressure storage container to store high pressure fuel, and the high pressure fuel is injected to a vehicle-mounted engine serving as an internal combustion engine. This system executes various controls with an electronic control unit (hereinafter referred to as an ECU) as a central processor. FIG. 1 shows a schematic configuration of the fuel injection system. In the following respective embodiments, parts that are the same as or equivalent to each other are denoted by the same reference numerals in the drawings, and a description of the parts denoted by the same reference numerals will be referred to.

First Embodiment

In a fuel injection system 10 of FIG. 1, a fuel tank 11 is connected to a fuel pump 13 via a low pressure fuel pipe 12. The fuel pump 13 is a mechanical high pressure pump that sucks in and discharges fuel as the engine 20 rotates. The fuel pump 13 sucks in low pressure fuel as a crankshaft 21 of the engine 20 rotates, then pressurizes the low pressure fuel and discharges the highly pressurized fuel (i.e., high pressure fuel). In the present embodiment, the fuel pump 13 is provided integrally with a low pressure pump for pumping fuel from the fuel tank 11 through the low pressure fuel pipe 12, but the low pressure pump may be provided separately in alternative embodiments.

A common rail 15 is connected to the fuel pump 13 via a high pressure fuel pipe 14. The high pressure fuel discharged from the fuel pump 13 is in turn supplied to the common rail 15, and the fuel is maintained in a high pressure state. The common rail 15 is provided with a rail pressure sensor 16 corresponding to a pressure detecting unit, and the fuel pressure in the common rail 15 (i.e., the rail pressure) is detected by the rail pressure sensor 16. Further, the common rail 15 is provided with a pressure reduction valve 17 for discharging the fuel in the common rail 15 to reduce the fuel pressure.

The engine 20 is a multi-cylinder diesel engine. The engine 20 is provided with an injector 22 as a fuel injection valve for each cylinder. Each injector 22 is supplied with the high pressure fuel in the common rail 15 through a high pressure fuel pipe 18. By driving the injector 22, high pressure fuel is directly injected into the combustion chamber of each cylinder. A return pipe 19 is connected to the pressure reduction valve 17 of the common rail 15, the fuel pump 13, and the injectors 22. Surplus fuel in the common rail 15, the fuel pump 13, and the injectors 22 passes through the return pipe 19 to return to the fuel tank 11.

Figure 2:
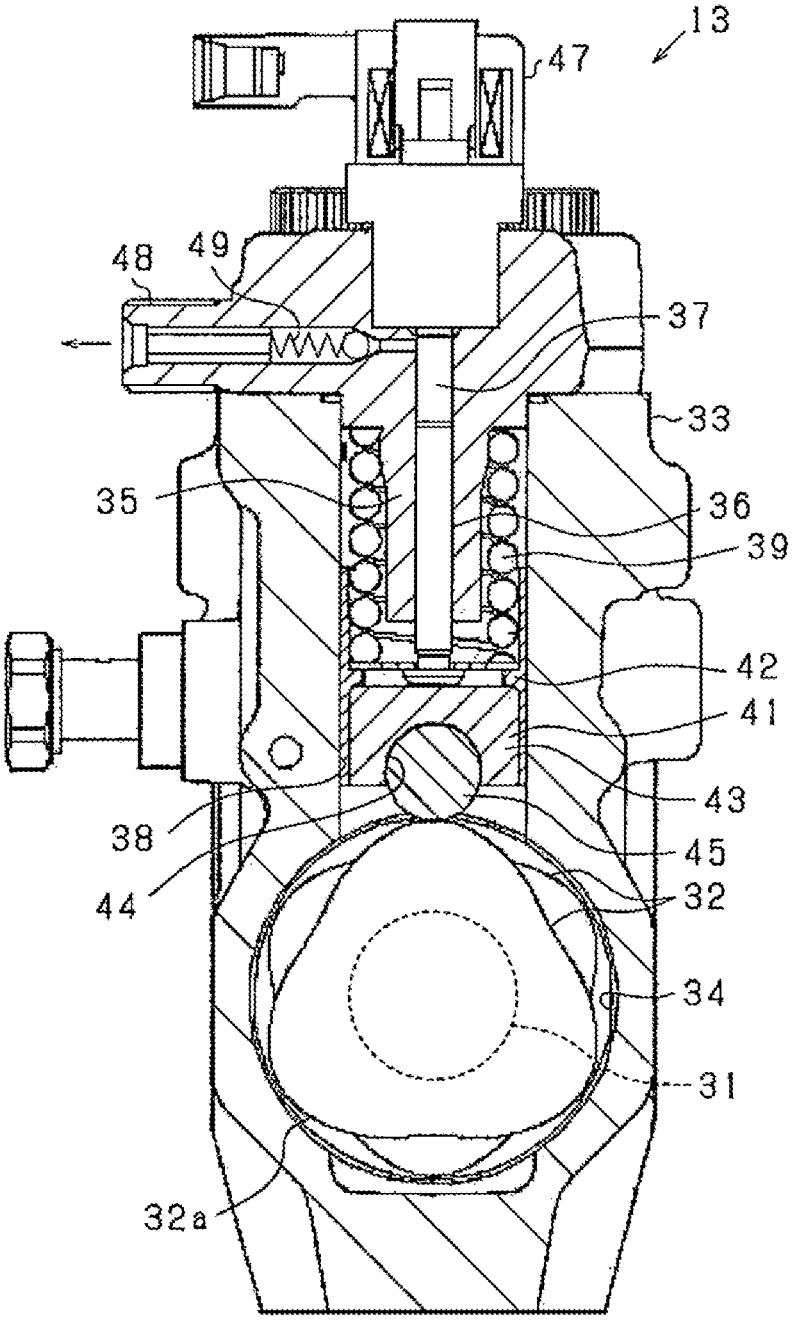
FIG. 2 is a cross sectional view showing a configuration of a fuel pump.

The configuration of the fuel pump 13 will be described below with reference to FIG. 2. Note that the fuel pump 13 of the present embodiment includes two fuel pump units arranged along the axial direction of the camshaft 31, and FIG. 2 shows a cross-sectional configuration of one fuel pump unit.

The fuel pump 13 includes a camshaft 31 that is driven to rotate with the rotation of the crankshaft 21 of the engine 20. The camshaft 31 is integrally provided with a cam 32. The camshaft 31 and the cam 32 are housed in a cam chamber 34 formed in a pump housing 33. The cam 32 has one or more cam ridges 32*a* (three in the example of FIG. 2) along the rotation direction of the camshaft 31. The cams 32 are provided such that the phases of the cam ridges 32*a* are offset from each other for each fuel pump unit.

In addition, a cylinder 35 is fixed to the pump housing 33, and a plunger 36 is housed in the cylinder 35 so as to be slidable along a reciprocating direction. The volume of a pressurizing chamber 37 varies in accordance with the reciprocating movement of the plunger 36, which is in turn in accordance with the rotation of the camshaft 31.

The fuel pump 13 includes a tappet 41 as a plunger drive mechanism. The tappet 41 causes the plunger 36 to reciprocate in accordance with the cam profile of the cam 32. The tappet 41 is housed in a housing hole 38 of the pump housing 33 between the cam 32 and the plunger 36. A spring 39 is accommodated in the housing hole 38. Due to the spring force of the spring 39, the plunger 36 is pressed against the tappet 41 and the tappet 41 is pressed against the cam 32. The rotation of the camshaft 31 and the cam 32 is converted into linear reciprocating motion by the tappet 41, and the plunger 36 reciprocates together with the tappet 41.

The tappet 41 has a cylindrical tappet body 42, a shoe 43, and a cylindrical roller 45. The shoe 43 is fixed to the inside of the tappet body 42, for example by press fitting in the radial direction. The roller 45 is provided in a state of being supported by the shoe 43. The shoe 43 has a semicircular concave portion 44 on the lower surface of the shoe 43 facing the cam 32. An inner peripheral surface 44*a* having an arc-shaped cross section is formed inside the concave portion 44. The roller 45 is provided in contact with the inner peripheral surface 44*a* in the concave portion 44, and partially protrudes out from the concave portion 44. Further, the roller 45 is in contact with an outer peripheral surface of the cam 32 (i.e., the cam surface), and the tappet 41 is displaced in the reciprocating direction according to the cam profile of the cam 32 while the roller 45 is maintained in contact with the cam surface.

When the cam 32 rotates, the roller 45 is in contact with each of the outer peripheral surface of the cam 32 and the inner peripheral surface 44*a* of the shoe 43. In this state, the roller 45 is displaced along the reciprocating direction together with the shoe 43 while rotating relatively. The cam chamber 34 is filled with lubricating oil. An oil film from the lubricating oil is formed between the roller 45 and the outer peripheral surface of the cam 32 as well as between the roller 45 and the inner peripheral surface 44*a* of the shoe 43. As such, the roller 45 is able to rotate while sliding. Here, even though an oil film is interposed between the roller 45 and the cam 32 or the shoe 43, this state is referring to as being in contact.

In addition, the fuel pump 13 is provided with an electromagnetically driven discharge metering valve 47. A discharge start timing is adjusted by energization control of the discharge metering valve 47, such that a fuel discharge amount (pump discharge volume) can be adjusted. Note that, as a fuel metering valve, a suction metering valve arranged at the fuel suction portion of the fuel pump 13 may be used instead of the discharge metering valve 47. Further, a discharge port 48 is provided with a discharge valve 49 that forms a check valve.

When the fuel pump 13 discharges fuel, the fuel sucked into the pressurizing chamber 37 is pressurized by the plunger 36. Then, when the pressurizing pressure in the pressurizing chamber 37 exceeds the sum of the fuel pressure on the common rail 15 side and the valve opening pressure of the discharge valve 49, the pressurized fuel is discharged toward the common rail 15 through the discharge valve 49.

The present system is a one-injection, one-pump fuel supply system in which fuel is pumped by the fuel pump 13 every time fuel injection is performed. In the present embodiment, the fuel pump 13 is provided with two fuel pump units, and the fuel pump units alternately pump fuel. However, in alternative embodiments, the fuel pump 13 may be provided with one fuel pump unit or three or more fuel pump units.

The ECU 50 is an electronic control unit including a conventional microcontroller structure having a CPU, a ROM, a RAM, and the like. A variety of signals are input to the ECU 50, including the detection signals of the above described rail pressure sensor 16, a crank angle sensor 51 that detects a rotation speed of the engine 20, an accelerator sensor 52 that detects an accelerator operation amount, and other various sensors. The crank angle sensor 51 is configured to output a pulse signal each time the crankshaft 21 reaches a predetermined rotation angle (for example, 30° CA) while rotating. By detecting the rising edge or falling edge of the pulse signal as edge information, the rotation angle of the crankshaft 21 (i.e., crank position) and the engine rotation speed can be calculated. More specifically, the rotation angle of the crankshaft 21 can be calculated by detecting each pulse edge, and the engine rotation speed can be calculated based on the time interval between pulse edges.

The ECU 50 determines an optimal fuel injection amount and an injection timing based on engine operation information such as the engine rotation speed and the accelerator operation amount, and outputs an injection control signal corresponding to the determined fuel injection amount and the injection timing to the injectors 22. Thus, in each cylinder of the engine 20, a fuel injection control by the injector 22 is performed. Further, the ECU 50 sets a target rail pressure, which is a target value of the rail pressure, based on the engine rotation speed and the fuel injection amount. Then, the ECU 50 performs feedback control on the pump discharge amount such that the actual rail pressure detected by the rail pressure sensor 16 reaches the target rail pressure. By controlling the rail pressure, the injection pressure of the fuel injected from the injector 22 is controlled.

Further, the ECU 50 has an idling stop function for automatically stopping and restarting the engine 20. The ECU 50 automatically stops the engine 20 based on a predetermined automatic stop condition being satisfied, and restarts the engine 20 based on a predetermined restart condition being satisfied. In the present embodiment, as structures related to engine start, a starter motor 61 and a rotating electric machine 62 are provided. The starter motor 61 causes the crankshaft 21 to start rotating when a pinion gear is meshed with a ring gear. The rotating electric machine 62 causes the crankshaft 21 to start rotating when a connecting member such as a belt is coupled to the crankshaft 21. The engine is started using either the starter motor 61 or the rotating electric machine 62. In particular, the engine 20 is started using the starter motor 61 at the time of engine start accompanying the start operation of a driver (i.e., the first start time). In addition, the engine 20 is started using the rotating electric machine 62 at the time of engine restart under idling stop control. Further, as the rotating electric machine 62, for example, an ISG (Integrated Starter Generator) which is a generator with a motor function may be used.

With the starter motor 61, the initial rotation applied to the engine 20 is at a predetermined cranking rotation speed (for example, 200 rpm), and the engine 20 is started with combusting starting during the initial rotation. In contrast, with the rotating electric machine 62, the engine can be started by rotation driving at a rotation speed higher than the cranking rotation speed of the starter motor 61. Further, by generating a propulsion torque, vehicle propulsion (i.e., torque assisted propulsion) is possible.

It should be noted that in the case where the engine 20 is started from a stopped state, if the oil film at the contact portion between the shoe 43 and the roller 45 is broken at the beginning of the engine start, there is a concern that galling may occur as a result. For example, when the engine 20 is stopped due to the stop of the vehicle, the oil film between the shoe 43 and the roller 45 may be broken during the stop. In this case, after the cam 32 begins rotating due to the start of the engine, until an oil film is formed again between the shoe 43 and the roller 45, the roller 45 is moved in a high friction state, which raises concerns of damage caused by galling.

The mechanism of oil film formation immediately after the cam 32 starts rotating will be described below. FIGS. 3A to 3E are explanatory diagrams showing transition states of oil film formation when the cam 32 first begins to rotate. FIGS. 3A to 3E show respective states that occur with the rotation of the cam 32 in chronological order. In FIG. 3, the concave portion 44 of the shoe 43 has an inner diameter larger than the outer size of the roller 45. Further, in FIG. 3, the cam 32 is a double cam, i.e., the cam profile of the cam 32 has two peaks, for convenience of explanation.

In FIG. 3, the contact point between the cam 32 and the roller 45 is P1, and the contact point between the shoe 43 and the roller 45 is P2. A pressure angle iv is defined as an angle formed by a straight line connecting the contact points P1 and P2 after the start of rotation of the cam 32 with respect to a reference straight line connecting the contact points P1 and P2 at the bottom rotation position of the cam 32 (i.e., a straight line parallel to the plunger reciprocating movement direction). The pressure angle ψ indicates the runout at the contact position between the shoe 43 and the roller 45 in the concave portion 44. Here, angles in the counterclockwise direction in the figure is a positive pressure angle ψ, and angles in the clockwise direction in the figure is a negative pressure angle ψ.

Figure 3A:
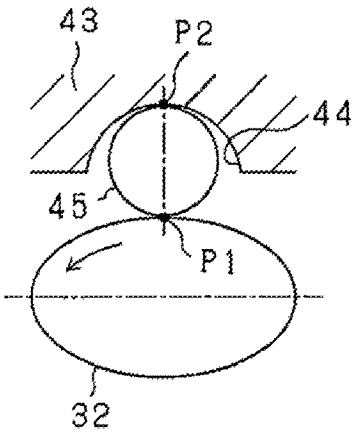
FIG. 3A is a view for explaining an oil film forming mechanism at a sliding portion of a tappet.

FIG. 3A shows the state when the cam 32 first begins to rotate. In this state, the cam 32 is at the bottom rotation position. Further, the roller 45 is in contact with the cam 32 at the bottom point of the cam 32. In addition, the roller 45 is in contact with the concave portion 44 of the shoe 43 at the uppermost position (vertex) of the concave portion 44. In this state, the oil film is broken at the contact portion between the shoe 43 and the roller 45. Then, the cam 32 starts to rotate counterclockwise from this state, and transitions to the state shown in FIG. 3B.

Figure 3B:
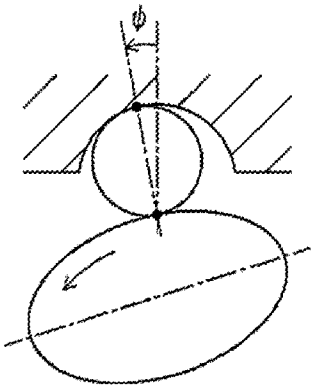
FIG. 3B is a view for explaining an oil film forming mechanism at a sliding portion of a tappet.

In the state shown in FIG. 3B, since no oil film is formed between the shoe 43 and the roller 45, when comparing a cam/roller friction coefficient μc and a shoe/roller friction coefficient μs, μc is smaller than μs. In this case, no slip occurs between the shoe 43 and the roller 45, and as a result slip occurs between the cam 32 and the roller 45 instead of rolling. Therefore, the roller 45 is displaced within the concave portion 44 according to the stress received from the outer peripheral surface of the cam, and the pressure angle ψ becomes positive.

Figure 3C:
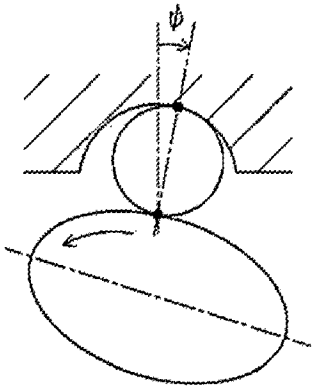
FIG. 3C is a view for explaining an oil film forming mechanism at a sliding portion of a tappet.

Thereafter, the cam 32 further rotates beyond the top rotation position, as shown in FIG. 3C. At this time, the direction of the stress received from the cam outer peripheral surface changes, and as a result the roller 45 is moved to the opposite side in the concave portion 44 as compared to FIG. 3B. Due to this, the pressure angle ψ becomes negative. In other words, comparing FIGS. 3B and 3C, it can be seen that the pressure angle ψ changes from positive to negative as the cam 32 rotates past the top rotation position.

Figure 3D:
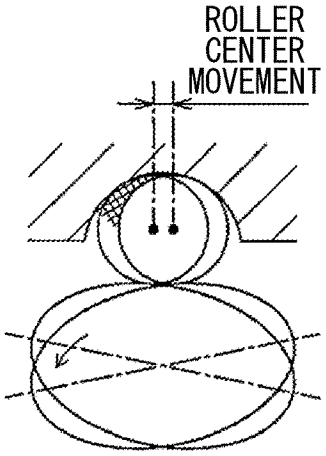
FIG. 3D is a view for explaining an oil film forming mechanism at a sliding portion of a tappet.

Thereafter, in the state shown in FIG. 3D, the cam 32 passes through the bottom rotation position. At this time, an oil film is formed between the shoe 43 and the roller 45 by the squeeze film effect (also referred to as simply squeeze effect). In particular, when the cam 32 passes through the bottom rotation position, the direction of the pressure angle ψ changes as the center point of the roller 45 moves as illustrated in FIG. 3D. Then, when the contact point P2 between the shoe 43 and the roller 45 moves from one side to the other side across the vertex position of the concave portion 44, an oil film is formed by the squeeze film effect. With the formation of the oil film, the shoe/roller friction coefficient μs decreases and becomes smaller than the cam/roller friction coefficient μc (μs<μc).

Figure 3E:
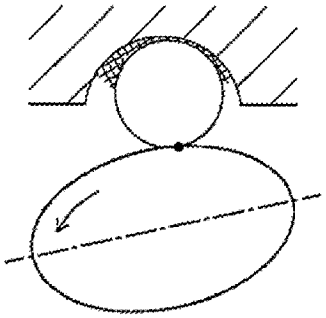
FIG. 3E is a view for explaining an oil film forming mechanism at a sliding portion of a tappet.

After the oil film is formed between the shoe 43 and the roller 45, as shown in FIG. 3E, slip occurs between the shoe 43 and the roller 45, and the roller 45 changes to a rolling state. In the state shown in FIG. 3E, the oil film formation is enhanced by the wedge film effect.

As described above, when the camshaft 31 begins to rotate in accordance with the start of rotation of the engine 20, an oil film is not formed between the shoe 43 and the roller 45 until the cam 32 transitions from the top rotation position and passes through the bottom rotation position. In particular, the oil film is formed during the period after the cam 32 has passed through the bottom rotation position and until the cam 32 reaches the next top rotation position. In the case of a double cam, the angle required to rotate from top to bottom then back to top is 180 degrees. In other words, an oil film is formed between the shoe 43 and the roller 45 during the time it takes the cam 32 to rotate by 180 degrees. In addition, when the engine 20 is stopped (and the fuel pump 13 is also stopped), it is conceivable that the cam 32 may be stopped at or near the bottom rotation position.

Considering this, it is desirable that an oil film is formed between the shoe 43 and the roller 45 while the cam 32 rotates 270 degrees from bottom, to top, back to bottom, and back to top.

In the case of a triple cam (i.e., a cam with a cam profile that has three equidistant peaks), the angle required to rotate from top to bottom then back to top is 120 degrees. In other words, an oil film is formed between the shoe 43 and the roller 45 during the time it takes the cam 32 to rotate by 120 degrees. Here as well, when the engine 20 is stopped (and the fuel pump 13 is also stopped), it is conceivable that the cam 32 may be stopped at or near the bottom rotation position. Considering this, it is desirable that an oil film is formed between the shoe 43 and the roller 45 while the cam 32 rotates 180 degrees from bottom, to top, back to bottom, and back to top.

In general, assuming that the number of cam ridges 32*a* in the cam 32 is n, the angle required for rotation from top to bottom and back to top is "360 degrees/n". In other words, when taking into consideration that the stop position of the cam 32 may vary, the maximum angle required for an oil film to be formed between the shoe 43 and the roller 45 is preferably "1.5×360 degrees/n".

The factors that cause galling in the fuel pump 13 at the sliding portion of the tappet 41 (i.e., the contact portion between the shoe 43 and the roller 45) include the rate of increase of the rotation speed of the camshaft 31 and the load transmitted to the tappet 41 via the plunger 36 during fuel discharge. In addition, it is considered that the possibility of galling increases in accordance with the magnitude of the product of a fuel discharge pressure (P) and a pump rotation speed rate of increase (V), also referred to as a PV value. Here, the fuel discharge pressure (P) corresponds to the load on the tappet 41. Further, the pump rotation speed rate of increase (V) refers to the rate of increase of the rotation speed of the camshaft 31 at the time of starting the engine. The fuel discharge pressure is the pressurizing pressure in the pressurizing chamber 37 at the time of fuel discharge, which depends on the rail pressure.

Figure 4:
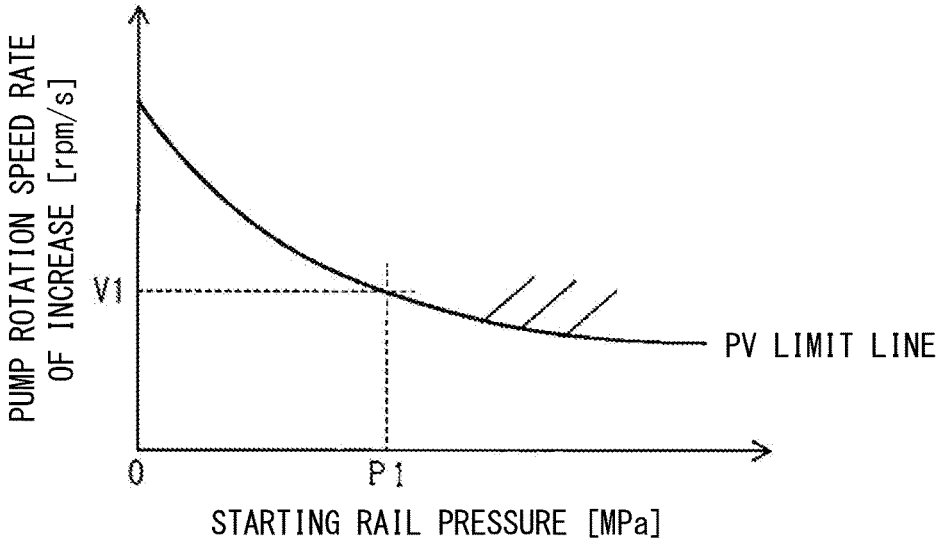
FIG. 4 is a diagram showing a relationship between a PV limit value with respect to a rail pressure and a rate of increase of pump rotation speed at the time of engine start.

FIG. 4 shows the relationship of a PV limit values with respect to and the rail pressure (measured in MPa) at the time of engine start as the pressure parameter (P) and the pump rotation speed rate of increase (measured in rpm/s) as the rotation parameter (V). In FIG. 4, a PV limit line is shown, and the region exceeding the PV limit line corresponds to a high possibility of damage (galling) in fuel pump 13.

In FIG. 4, for example when the starting rail pressure is P1, damage to the fuel pump 13 may be reduced or prevented by setting the pump rotation speed rate of increase to be smaller than V1. Conversely, when the pump rotation speed rate of increase is V1, damage to the fuel pump 13 may be reduced or prevented by setting the rail pressure at the time of engine start to be smaller than P1.

When the engine 20 is restarted, if the engine is restarted by the rotating electric machine 62, the V parameter is relatively high because the rotating electric machine 62 is a high-torque motor. When this occurs, if the starting rail pressure also increases to a high level, there is a concern that the PV value may exceed the upper limit, which increases the risk of damage to the fuel pump 13. Therefore, in order to reduce damage to the fuel pump 13 when the engine is restarted by the rotating electric machine 62, a control process is performed during engine restart to limit the fuel discharge pressure of the fuel pump 13 (i.e., a P reduction process) in order to limit the PV value.

Conversely, for example when the amount of leak in the fuel pump 13 is limited or when a fuel pressure retention control process is performed while the engine is stopped, the rail pressure at the time of engine start is in a high pressure state, i.e., the P parameter is relatively high. Under this condition, if the pump rotation speed rate of increase also increases to a high level, there is a concern that the PV value may exceed the upper limit, which increases the risk of damage to the fuel pump 13. Therefore, in such a case, the pump rotation speed is limited during engine start (i.e., a V reduction process) in order to limit the PV value.

Figure 5:
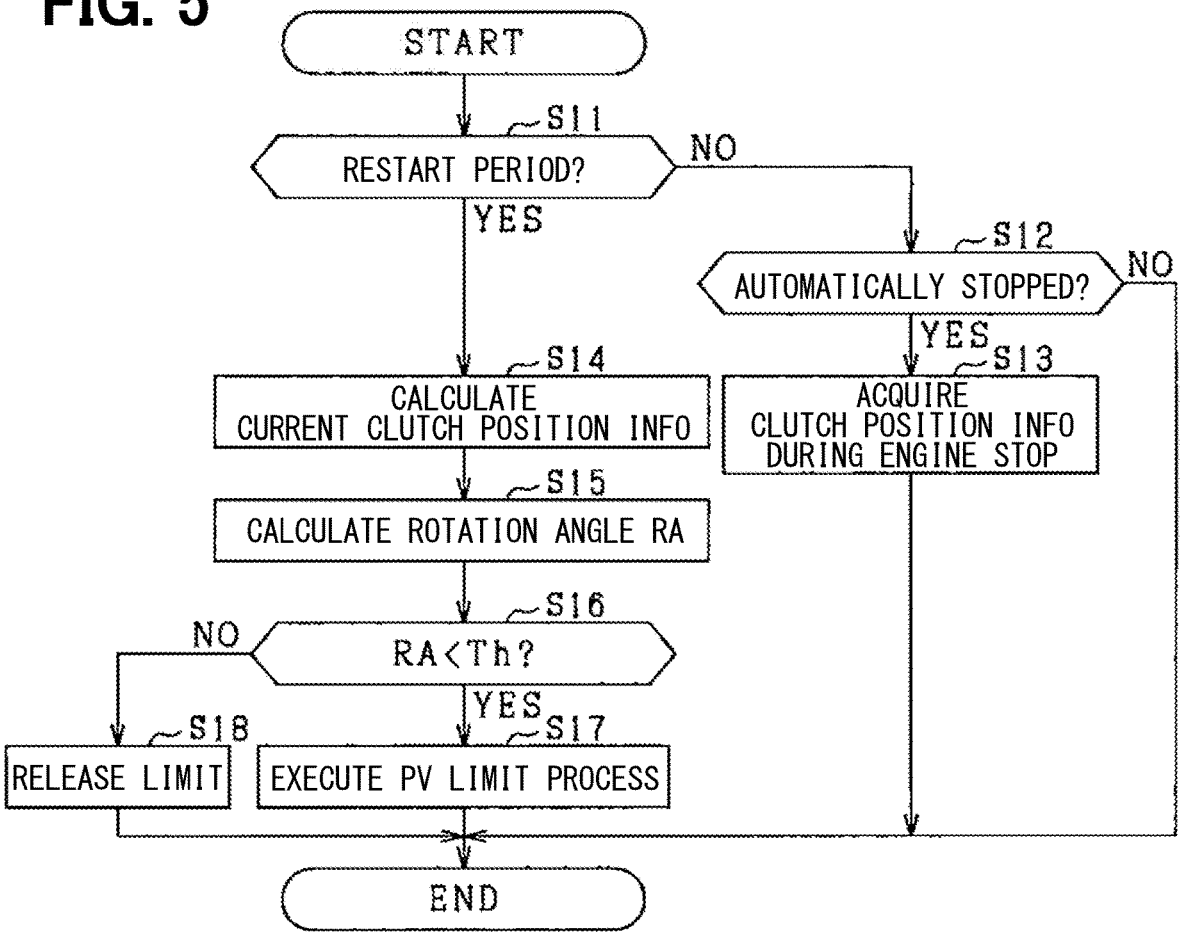
FIG. 5 is a flowchart showing an engine start control process.

FIG. 5 is a flowchart showing an engine start control process. This process is repeatedly executed by the ECU 50 periodically while the ignition switch IG is turned on. The process of FIG. 5 is for the purpose of limiting the PV value when the engine 20 is restarted during idling stop control.

In FIG. 5, in step S11, it is determined whether the current state is during a restart period in which the engine 20 is restarted. The restart period of the engine 20 may be, for example, a period after the engine 20 is automatically stopped from when a restart condition is satisfied to when a predetermined amount of time elapses. If step S11 is NO, the process proceeds to step S12, and if step S11 is YES, the process proceeds to step S14.

In step S12, it is determined whether or not the engine 20 currently has been automatically stopped. If the engine 20 is being automatically stopped, the process proceeds to step S13 in which the crank position information of the stopped engine is acquired. At this time, for example, the crank position number calculated immediately before the engine stops may be acquired.

In step S14, the current crank position is calculated based on the pulse signal output from the crank angle sensor 51. Then next, at step S15, based on the crank position information from the engine stopped state and the current crank position, the rotation angle RA of the camshaft 31 from the start of rotation due to the engine restart is calculated. Specifically, at this time, based on the difference between the crank position during the engine stopped state the and the current crank position, the rotation angle of the crankshaft 21 caused by the engine restart is calculated. Then, the rotation angle RA of the camshaft 31 is calculated through a conversion based on the rotation ratio between the crankshaft 21 and the camshaft 31.

Next, in step S16, it is determined whether or not the rotation angle RA of the camshaft 31 is less than a predetermined value Th. The predetermined value Th is a threshold value for determining a rotation angle required for forming an oil film between the shoe 43 and the roller 45 after the rotation of the camshaft 31 is started. For example, if the cam 32 of the fuel pump 13 is a double cam, Th=270 degrees, and if the cam 32 of the fuel pump 13 is a triple cam, then Th=180 degrees. If the rotation angle RA is smaller than the predetermined value Th, the process proceeds to step S17. If the rotation angle RA is equal to or larger than the predetermined value Th, the process proceeds to step S18.

In step S17, the fuel discharge of the fuel pump 13 is stopped to limit the PV value which is the product of the pressure parameter (P) and the rotation speed parameter (V). Specifically, by keeping the discharge metering valve 47 in an open state, the fuel pump 13 does not discharge fuel. In this case, since the fuel is not pressurized in the pressurizing chamber 37, the load on the tappet 41 is reduced.

In step S18, the limit on the PV value is released. As a result, subsequent fuel discharge by the fuel pump 13 is permitted.

Figure 6:
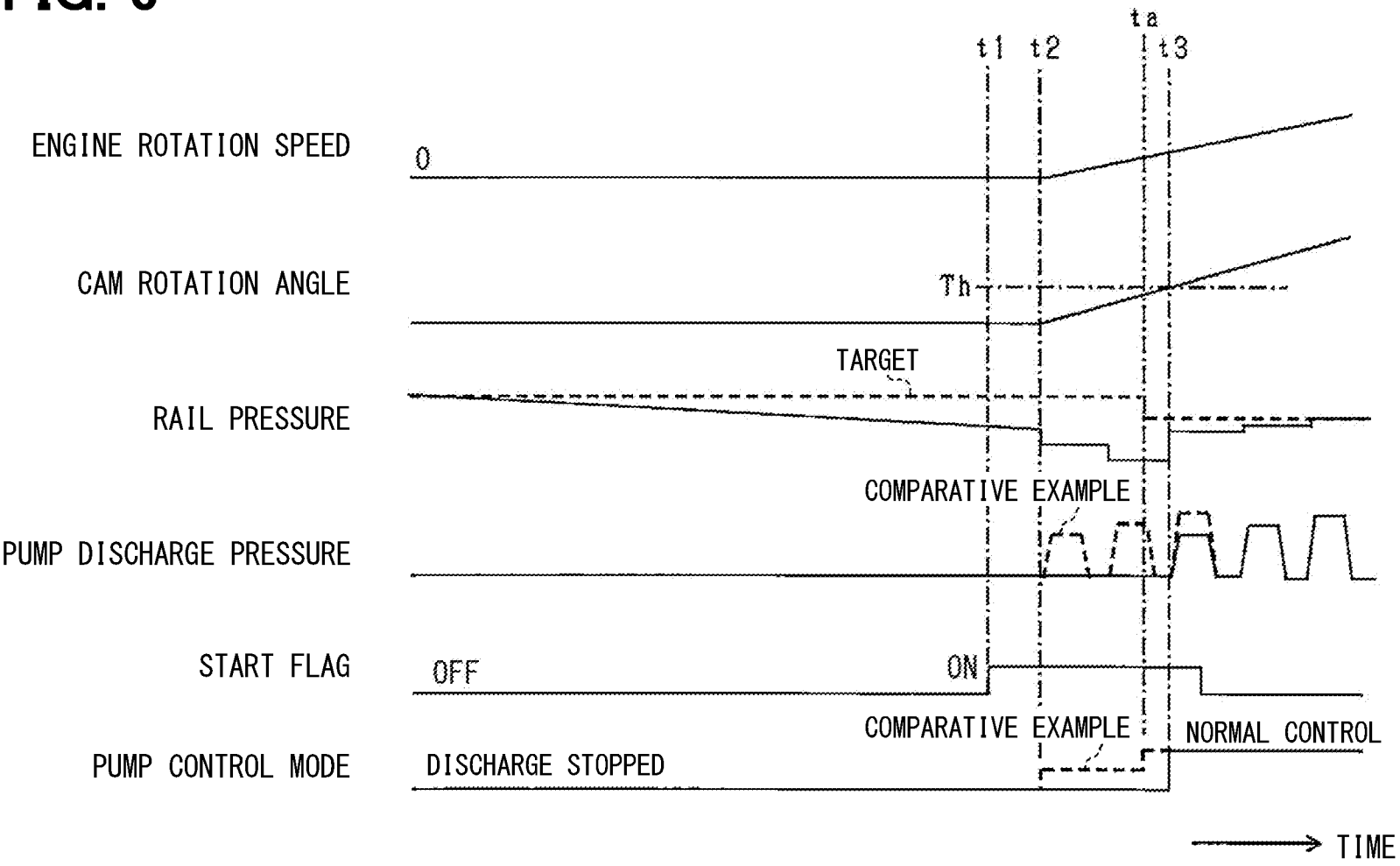
FIG. 6 is a time chart showing an engine start control.

FIG. 6 is a time chart showing the engine start control process more specifically. In FIG. 6, the engine 20 is automatically stopped before time t1, and the engine 20 is restarted at time t1.

In FIG. 6, before time t1, the fuel pump 13 is stopped due to the automatic stop of the engine, and the rail pressure gradually decreases due to an internal leak or the like in the fuel pump 13. At this time, the actual rail pressure gradually decreases with respect to the target rail pressure.

Then, at time t1, when the engine restart condition is satisfied, the start flag is turned on, and the rotation of the rotating electric machine 62 restarts the engine 20. As the rotating electric machine 62 is driven, the rotation of the crankshaft 21 of the engine 20 is started, and the rotation of the camshaft 31 of the fuel pump 13 is started in accordance with the rotation of the crankshaft 21. At and after time t2, the pulse signal from the crank angle sensor 51 is acquired to calculate the engine rotation speed, which gradually increases.

After the rotation of the crankshaft 21 of the engine 20 is started, the camshaft 31 of the fuel pump 13 is also rotated, but since the discharge metering valve 47 is kept open, fuel discharge is not performed Next, at time t3, the rotation angle RA of the camshaft 31, which is calculated based on the pulse signal of the crank angle sensor 51, reaches a predetermined value Th. As a result, fuel discharge from the fuel pump 13 is permitted (see the pump control mode flag in FIG. 6). Specifically, the period from the start of rotation until the rotation angle RA of the camshaft 31 reaches the predetermined value Th (i.e., period t1 to t3) has a high probability of no oil film being formed between the shoe 43 and the roller 45 in the fuel pump 13. During this period, the fuel pump 13 is prevented from pumping fuel in order to lower the PV value.

After time t3, it is considered that an oil film has completely formed between the shoe 43 and the roller 45 in the fuel pump 13, and the fuel pump 13 begins to pump fuel.

FIG. 6 also shows a comparative example control process in which the fuel discharge of the fuel pump 13 is started after time t2, as indicated by the dashed line in the pump discharge pressure chart. In this case, when the camshaft 31 begins to rotate, the pressurizing pressure in the pressurizing chamber 37 of the fuel pump 13 acts on the tappet 41 via the plunger 36, and there is a concern about galling caused by the tappet 41. In contrast, in the configuration of the present embodiment, since fuel discharge by the fuel pump 13 is stopped when the camshaft 31 first begins to rotate, the pressurizing pressure in the pressurizing chamber 37 does not act on the tappet 41, thereby removing concern of galling. Further, at time ta in FIG. 6, angle synchronization control is started in accordance with the start of the rotation of the crankshaft 21 of the engine 20. After time ta, feedback control is performed on the rail pressure with respect to a target rail pressure.

In the above-described configuration, in step S17 of FIG. 5, the process of stopping the fuel discharge of the fuel pump 13 is performed as the control process for limiting the PV value. However, this process may be modified as described below. Further, it should be noted that each of the various time charts described below shows a situation in which the engine 20 is restarted from a state where the engine 20 has been automatically stopped, similar to FIG. 6.

(PV Limiting Process 1)

The ECU 50 performs a control process for reducing the fuel discharge amount of the fuel pump 13 in step S17 in FIG. 5. Specifically, a process of lowering the target rail pressure as compared to normal operation, or a process of reducing the fuel discharge amount as compared to normal operation and then performing fuel discharge based on the reduced fuel discharge amount is performed. In this case, the degree to which the fuel discharge amount is decreased (i.e., the degree of discharge limiting) may be variably set based on the pump rotation speed at the time of engine start or the pump rotation speed rate of increase (i.e., the V value). The higher the pump rotation speed or the pump rotation speed rate of increase at engine start, the greater the degree to which the fuel discharge amount is reduced.

Figure 7:
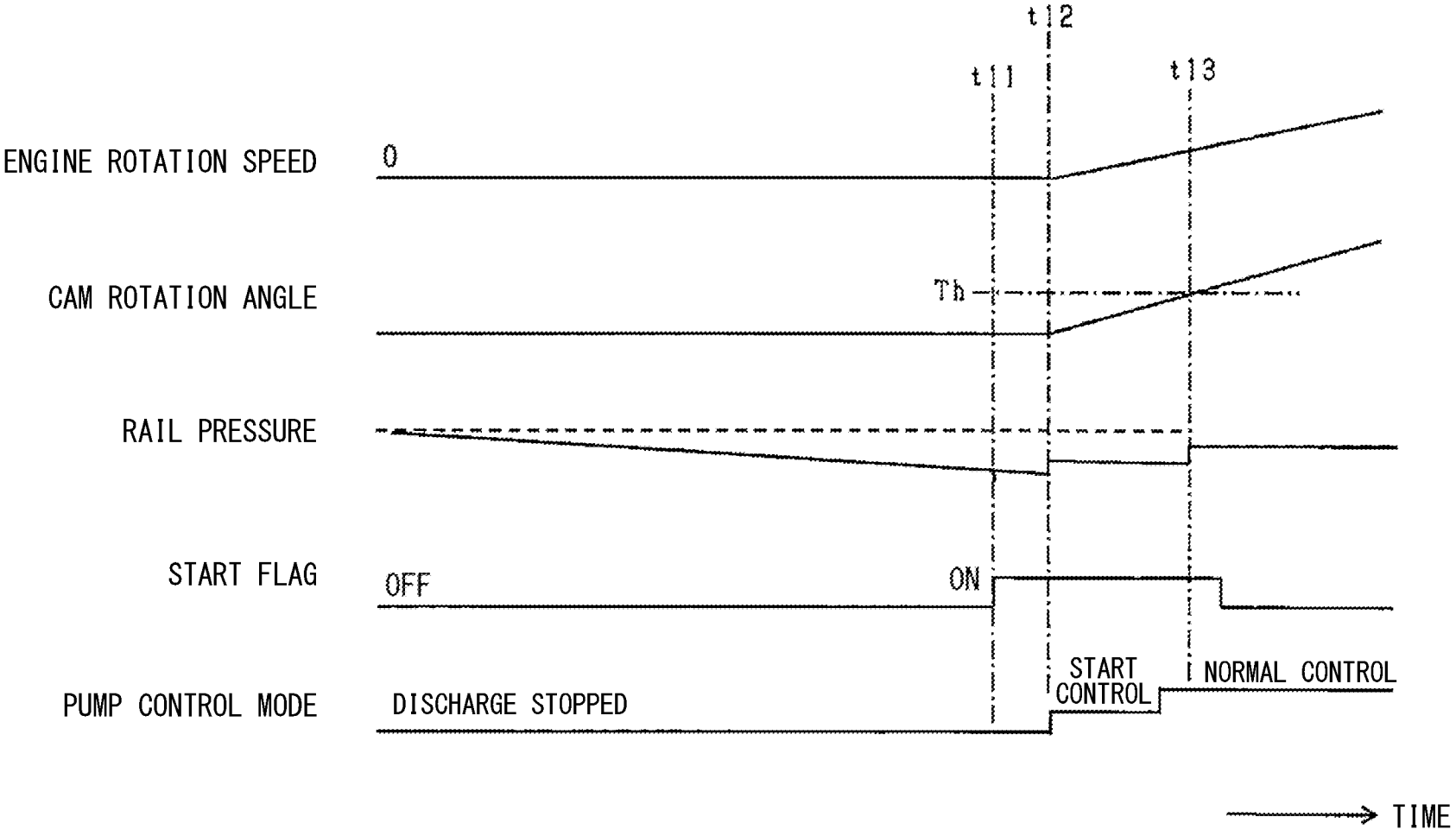
FIG. 7 is a time chart showing an engine start control.

FIG. 7 shows a time chart corresponding to the present example. In FIG. 7, before time t11, the fuel pump 13 is stopped due to the automatic stop of the engine, and the rail pressure gradually decreases due to an internal leak or the like in the fuel pump 13. Then, at time t11, when the engine restart condition is satisfied, the rotation of the rotating electric machine 62 restarts the engine 20.

Thereafter, at time t12, fuel discharge by the fuel pump 13 is started. At this time, the fuel pump 13 performs fuel discharge at a reduced fuel discharge amount. As a result, the rail pressure is limited.

Next, at time t13, the rotation angle RA of the camshaft 31, which is calculated based on the pulse signal of the crank angle sensor 51, reaches a predetermined value Th. Along with this, the limit on the fuel discharge from the fuel pump 13 is released. Then, after time t13, the fuel pump 13 is controlled to operate in a typical manner.

(PV Limiting Process 2)

In step S17 of FIG. 5, the ECU 50 performs a control process for limiting the pump rotation speed (i.e., a rotation speed limiting process for the camshaft 31) in order to limit the pump rotation speed during engine start. Specifically, the ECU 50 reduces the starting rotation speed of the rotating electric machine 62 as compared to normal operation. In this case, the degree to which the starting rotation speed of the rotating electric machine 62 is limited may be variably set based on the rail pressure (i.e., the P value) at the time of engine start. It is preferable that the higher the rail pressure at the time of starting the engine, the greater the degree to which the starting rotation speed of the rotating electric machine 62 is limited.

Figure 8:
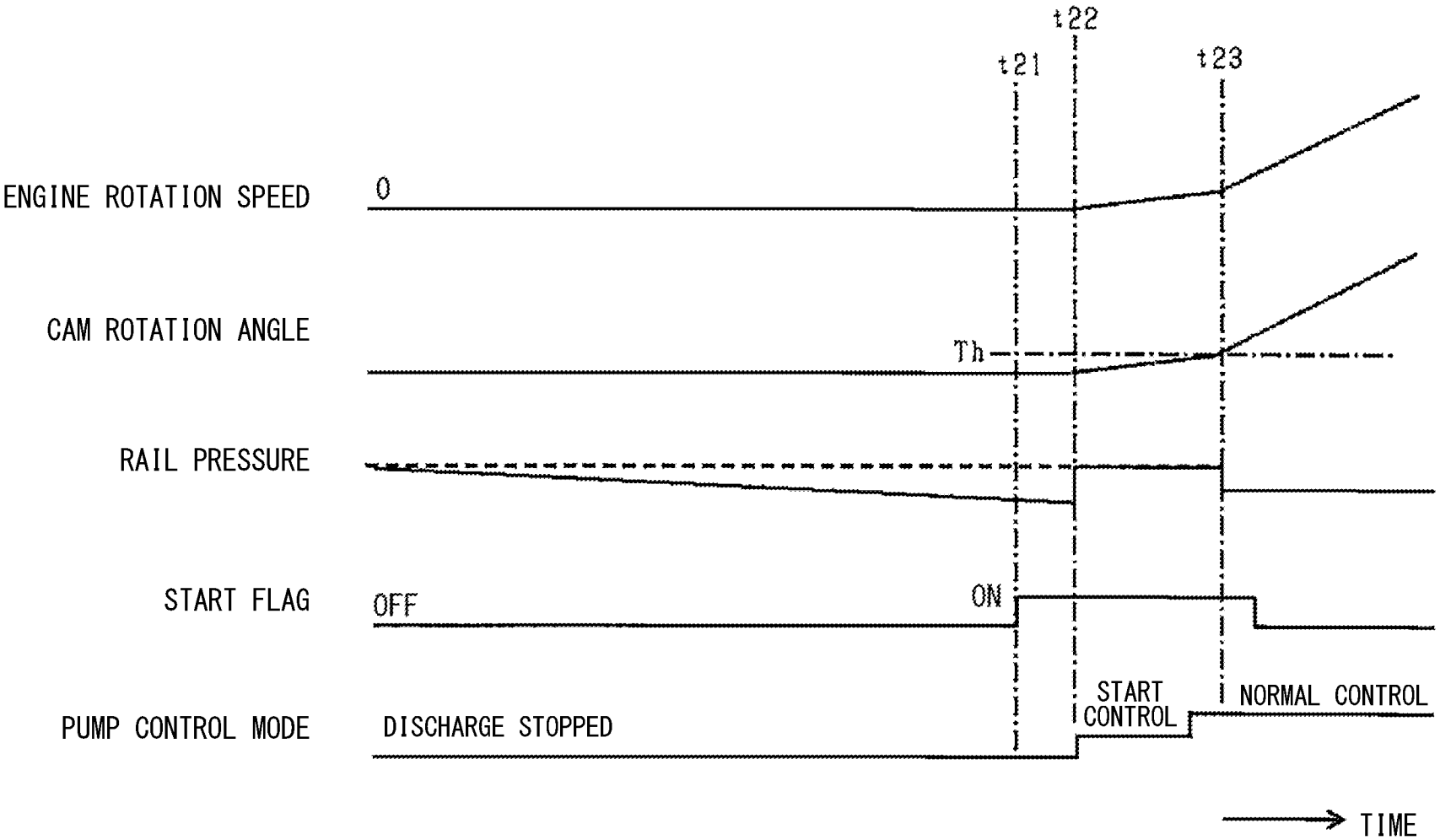
FIG. 8 is a time chart showing an engine start control.

FIG. 8 shows a time chart corresponding to the present example. In FIG. 8, before time t21, the fuel pump 13 is stopped due to the automatic stop of the engine, and the rail pressure gradually decreases due to an internal leak or the like in the fuel pump 13. Then, at time t21, when the engine restart condition is satisfied, the rotation of the rotating electric machine 62 restarts the engine 20. In this case, the rotation speed of the rotating electric machine 62 is reduced from the normal rotation speed, so that the pump rotation speed at engine start is limited.

Thereafter, at time t22, fuel discharge by the fuel pump 13 is started. In this example, the fuel pump 13 is controlled to operate in a normal manner. In other words, a start control is performed on the fuel pump 13 prior to angle synchronization, and normal feedback control is performed on the fuel pump 13 after angle synchronization.

Next, at time t23, the rotation angle RA of the camshaft 31, which is calculated based on the pulse signal of the crank angle sensor 51, reaches a predetermined value Th. Along with this, the limit on the starting rotation speed of the rotating electric machine 62, i.e., the pump rotation speed limit, is released. Thus, after time t23, the rate of increase of the engine rotation speed increases.

(Other PV Limiting Processes)

As a limitation on the fuel discharge pressure of the fuel pump 13, a process of discharging the fuel in the common rail 15 to reduce the fuel pressure (rail pressure) may be performed. Specifically, in step S17 in FIG. 5, the ECU 50 releases the high pressure fuel from the common rail 15 by opening the pressure reduction valve 17, thereby reducing the rail pressure. In this case, the fuel discharge pressure of the fuel pump 13 can be limited by reducing the rail pressure when first starting the engine 20.

Further, to limit the rotation speed of the camshaft 31, a process of stopping the fuel injection of the injector 22 or reducing the fuel injection amount of the injector 22 may be performed. Specifically, in step S17 of FIG. 5, the ECU 50 stops the fuel injection of the injector 22 or reduces the fuel injection amount of the injector 22, thereby limiting the increase of the rotation speed of the camshaft 31. In this case, when first starting the engine 20, increase in the engine rotation speed is limited by stopping fuel injection or decreasing the fuel injection amount. As a result, the rotation speed of the camshaft 31 can be limited.

Further, when first starting the engine 20, both the process of limiting the fuel discharge pressure of the fuel pump 13 and the process of limiting the rotation speed of the camshaft 31 can be performed.

According to this embodiment described in detail up to this point, the following effects are brought about:

When starting the engine, it is determined whether or not the rotation angle RA of the camshaft 31 from the start of rotation is under a predetermined angle (the predetermined value Th) required for forming an oil film on the sliding portion of the tappet 41. Then, when the rotation angle RA is determined to be under the predetermined angle, at least one limit process of limiting the fuel discharge pressure of the fuel pump 13 or limiting the rotation of the camshaft 31 is performed. In this case, by using the rotation angle RA of the camshaft 31 when beginning to rotate during engine start as a parameter, the state of formation of an oil film on the sliding portion of the tappet 41 can be properly assessed. In addition, since the fuel discharge pressure of the fuel pump 13 and the rotation of the camshaft 31 are restricted on condition that the rotation angle RA is less than the predetermined angle, these restrictions can be performed only when appropriate. In other words, it is possible to avoid unnecessary delays when starting the operation of the fuel pump 13. As a result, it is possible to appropriately prevent the occurrence of damage to the fuel pump 13 at the time of engine start.

In order to limit the fuel discharge pressure of the fuel pump 13, any of the following processes may be performed: a process of stopping the fuel discharge of the fuel pump 13, a process of decreasing the fuel discharge amount of the fuel pump 13, and a process of discharging the fuel in the common rail 15 to reduce fuel pressure. Thus, during engine start, the fuel discharge pressure (P) corresponding to the load on the tappet 41 can be appropriately reduced.

Further, to limit the rotation of the camshaft 31, any one of the following processes may be performed: a process for stopping the fuel injection of the injector 22 or reducing the fuel injection amount of the injector 22, and a process for limiting the rotation of the starter device. As a result, at the time engine start, the pump rotation speed (V) can be appropriately reduced. As a result, the PV value is reduced, and damage to the fuel pump 13 can be properly prevented.

At the time of engine start, it is determined whether or not the rotation angle RA of the camshaft 31 from the start of rotation is less than a predetermined angle defined as "1.5× 360 degrees/n". As a result, it is possible to determine whether the camshaft 31 has been rotated by an angle required for forming the oil film on the sliding portion of the tappet 41. Accordingly, appropriate control can be performed when during engine start, while taking into account the oil film formation mechanism of the tappet structure having the shoe 43 and the roller 45.

Hereinafter, embodiments other than the first embodiment will be described focusing on differences from the first embodiment.

Second Embodiment

In the present embodiment, after the start of the engine 20, a rotation speed peak value for each combustion according to the fuel injection of the injectors 22 is calculated, and the rotation of the camshaft 31 is limited based on the rotation speed peak value.

Figure 9:
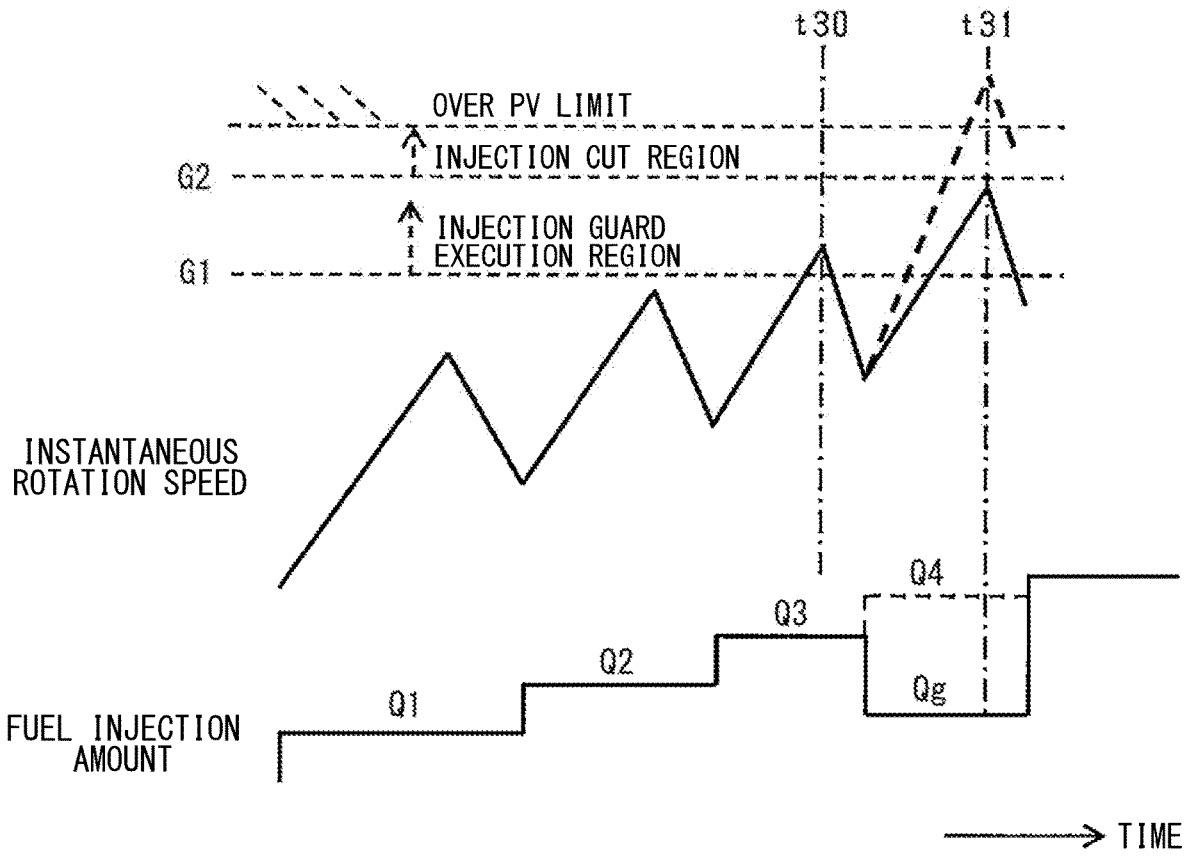
FIG. 9 is a time chart showing an engine start control in a second embodiment.

The outline of the start control process of the present embodiment will be described based on the time chart of FIG. 9. FIG. 9 shows changes in the instantaneous engine speed and changes in the fuel injection amount when beginning the engine start process. The instantaneous engine rotation speed is determined at each predetermined rotation angle (30° CA) of the crankshaft 21, and may be calculated based on, for example, the time interval (edge interval) of the pulse signal output from the crank angle sensor 51.

In FIG. 9, after the start of the engine 20, the instantaneous engine rotation speed gradually increases each time fuel is injected from the injector 22. More specifically, when combustion occurs in each cylinder after each fuel injection, the instantaneous engine speed changes while repeatedly increasing and decreasing over each combustion. The engine instantaneous rotational speed changes so as to have a bottom value near TDC and a peak value near BDC for each cylinder in the engine 20. The average rotation speed, which is the average value of the instantaneous rotation speed of the engine, gradually increases.

In this case, the peak value of the instantaneous engine rotation speed increases as the number of combustions increases, and there is a concern that the risk of damage to the tappet 41 due to seizure may occur with the increase in the peak value of the instantaneous engine rotation speed. In FIG. 9, fuel injection is performed at predetermined intervals of fuel injection amounts, specifically Q1, Q2, Q3, and Q4. Among these fuel injection amounts, the combustion accompanying the fuel injection of Q4 indicated by the dashed line would cause the engine instantaneous rotation speed to exceed the PV limit value (time t31).

Therefore, in the present embodiment, the peak value of the instantaneous engine speed is calculated every combustion, and the rotation of the camshaft 31 is restricted based on this peak value. Specifically, a guard threshold value G1 is set as a threshold value of the engine instantaneous rotation speed below the rotation speed corresponding to the PV limit value. If the peak value of the engine instantaneous rotation speed exceeds the guard threshold value G1, the subsequent fuel injection amount is limited to a guard injection amount Qg (time t30). Due to the limitation on the fuel injection amount, the rotation of the camshaft 31 is limited (and thus the pump rotation speed is limited).

Figure 10:
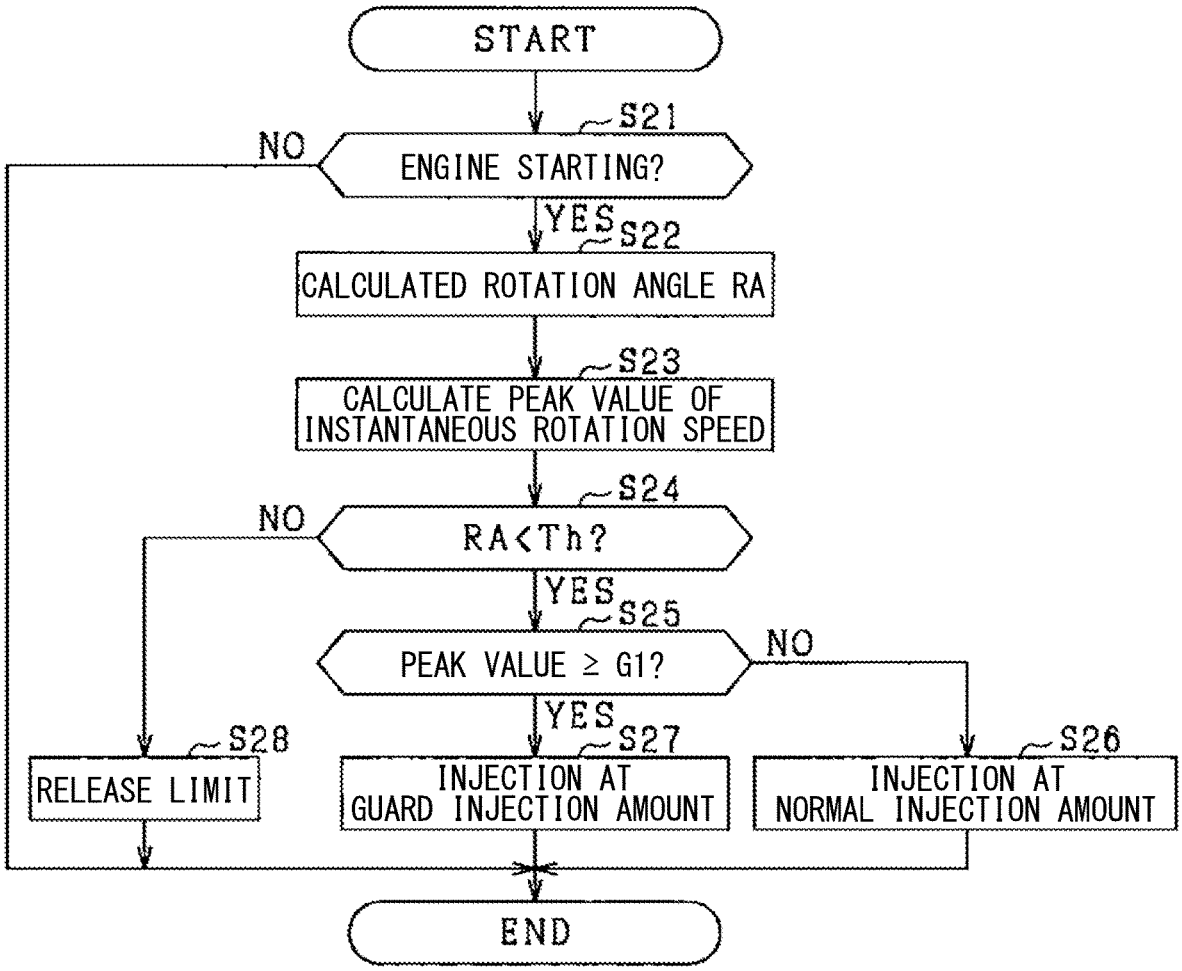
FIG. 10 is a flowchart showing an engine start control process in the second embodiment.

FIG. 10 is a flowchart showing an engine start control process. This process is repeatedly executed by the ECU 50 periodically while the ignition switch IG is turned on. In FIG. 10, the calculation process of the rotation angle RA of the camshaft 31 (that is, the cam rotation angle from the start of rotation due to the restart of the engine) is omitted for brevity, but the same process as that in FIG. 5 described above may be performed.

In FIG. 10, in step S21, it is determined whether or not the engine is being started. If YES, the process proceeds to step S22. At step S22, based on the current crank position, the rotation angle RA of the camshaft 31 from the start of rotation due to the engine restart is calculated. In step S23, the peak value of the instantaneous engine speed is calculated.

Next, in step S24, it is determined whether or not the rotation angle RA of the camshaft 31 is less than a predetermined value Th. The predetermined value Th is a threshold value for determining a rotation angle required for forming an oil film between the shoe 43 and the roller 45 after the rotation of the camshaft 31 is started as described above. If the rotation angle RA is less than the predetermined value Th, the process proceeds to step S25.

In step S25, it is determined whether or not the peak value of the instantaneous engine speed is equal to or greater than the guard threshold value G1. In this step S25, it is determined whether or not there is a possibility that the instantaneous engine speed may enter a region where the risk of damage is high when the combustion due to the next fuel injection occurs.

If the peak value of the instantaneous engine speed is less than the guard threshold value G1, the process proceeds to step S26, and the fuel injection is performed at the normal injection amount. Here, a normal injection amount refers to the fuel injection amounts Q1 to Q4 shown in FIG. 9. It should be noted that the fuel injection amounts Q1 to Q4 are exemplary in nature, and in alternate embodiments may be gradually increased or may be constant. If the peak value of the instantaneous engine speed is equal to or greater than the guard threshold value G1, the process proceeds to step S27, where the fuel injection amount is limited to the guard injection amount Qg, and the fuel injection is performed at the guard injection amount Qg.

If the rotation angle RA is less than the predetermined value Th in step S24, the process proceeds to step S28. In step S28, if the fuel injection amount is limited to the guard injection amount Qg, the limit is released.

Further, as shown in FIG. 9, another threshold value G2 is defined between the rotation speed corresponding to the PV limit value and the guard threshold value G1. If the peak value of the engine instantaneous rotation speed exceeds the threshold value G2, the next fuel injection may be stopped entirely (i.e., fuel cut is performed).

According to the present embodiment, at the time of starting the engine, it is possible to prevent the rotation speed of the camshaft 31 from excessively increasing to a level at which the risk of damage is high before the oil film is formed on the sliding portion of the tappet 41.

Figure 11:
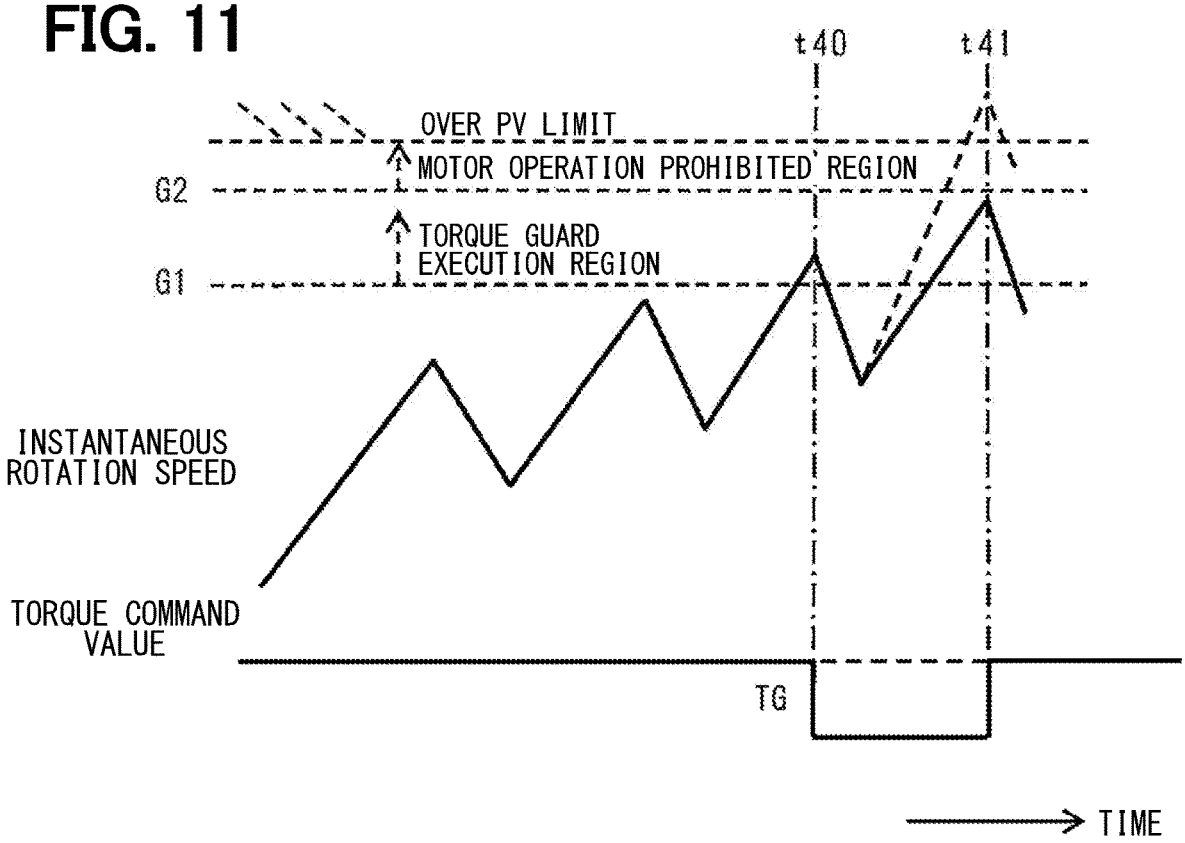
FIG. 11 is a time chart showing an engine start control in a second embodiment.

As another example of the present embodiment, the embodiment shown in FIG. 11 is contemplated. In FIG. 11, similarly to FIG. 9, after the start of the engine 20, the fuel is injected from the injector 22 at predetermined intervals, and the resulting combustions cause the instantaneous engine speed to change while repeatedly increasing and decreasing. In FIG. 11, when the engine is started, the rotating electric machine 62 is driven with a predetermined torque command value.

In this case, as the average rotation speed gradually increases, the instantaneous engine rotation speed may exceed the PV limit value at, for example, time t41. Therefore, when it is determined that the peak value of the instantaneous engine speed is equal to or greater than the guard threshold value G1, the ECU 50 sets a guard command value TG as the torque command value, and drives the rotating electric machine 62 based on the guard command value TG (time t40).

The rotating electric machine 62 may have a configuration including a speed reducer. In this case, the ECU 50 may change the speed ratio (e.g., gear ratio) of the speed reducer based on the change in the torque command value as a gear change control.

Further, as shown in FIG. 11, another threshold value G2 is defined between the rotation speed corresponding to the PV limit value and the guard threshold value G1. If the peak value of the engine instantaneous rotation speed exceeds the threshold value G2, the next drive of the rotating electric machine may be stopped entirely.

Third Embodiment

In this embodiment, after starting the engine 20, the rail pressure of the fuel pump 13 is acquired for every fuel discharge event, and the rotation of the camshaft 31 is limited based on this rail pressure.

Figure 12:
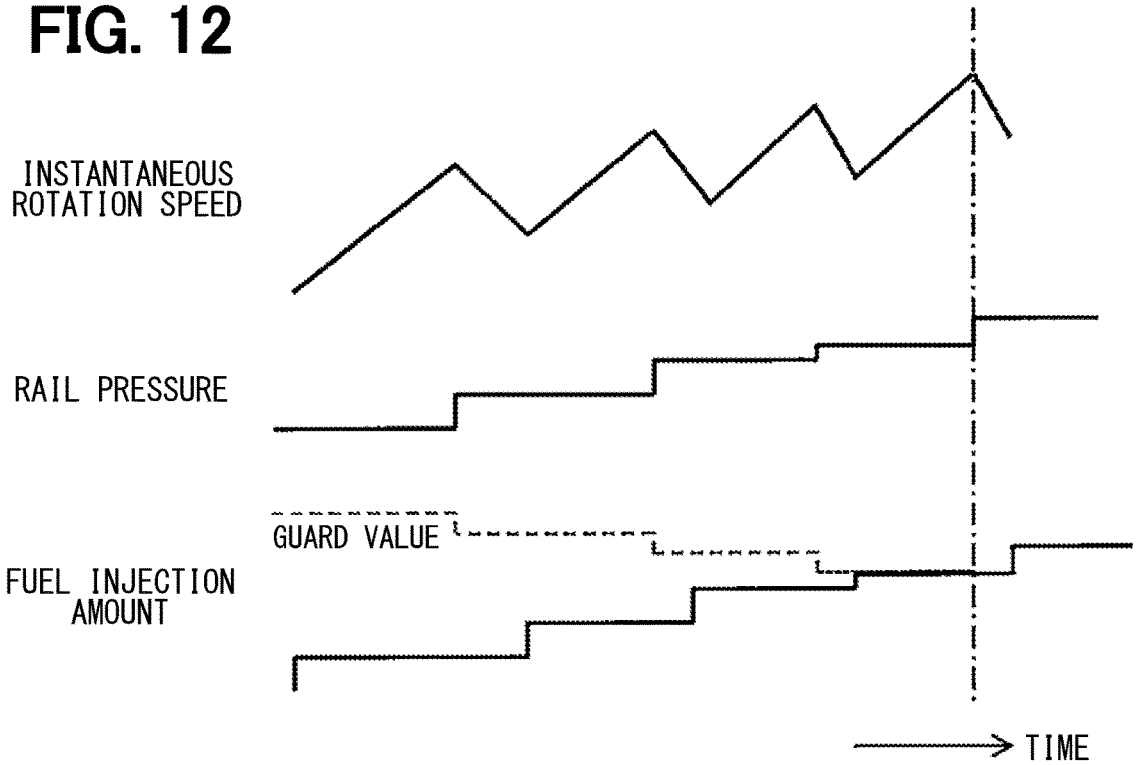
FIG. 12 is a time chart showing an engine start control in a third embodiment.

The outline of the start control process of the present embodiment will be described based on the time chart of FIG. 12. FIG. 12 shows changes in the instantaneous engine speed, changes in the rail pressure, and changes in the fuel injection amount when beginning the engine start process. FIG. 12 shows the pressure obtained at the TDC position of the engine 20 as the rail pressure.

In FIG. 12, after the start of the engine 20, the instantaneous engine speed changes while repeatedly increasing and decreasing each time combustion occurs as a result of fuel being injected from the injector 22. Further, rail pressure is gradually increased by the fuel pump 13 discharging the fuel. In this case, as the rail pressure increases, the PV value approaches the limit value. Therefore, in this embodiment, an injection amount guard value is set as a V limit value (rotation speed limit value) in accordance with the rail pressure of each fuel discharge of the fuel pump 13. The injection amount guard value acts as an upper limit guard on the fuel injection amount. Due to the upper limit guard on the fuel injection amount, the rotation of the camshaft 31 is limited (the pump rotation speed is limited).

Figure 13:
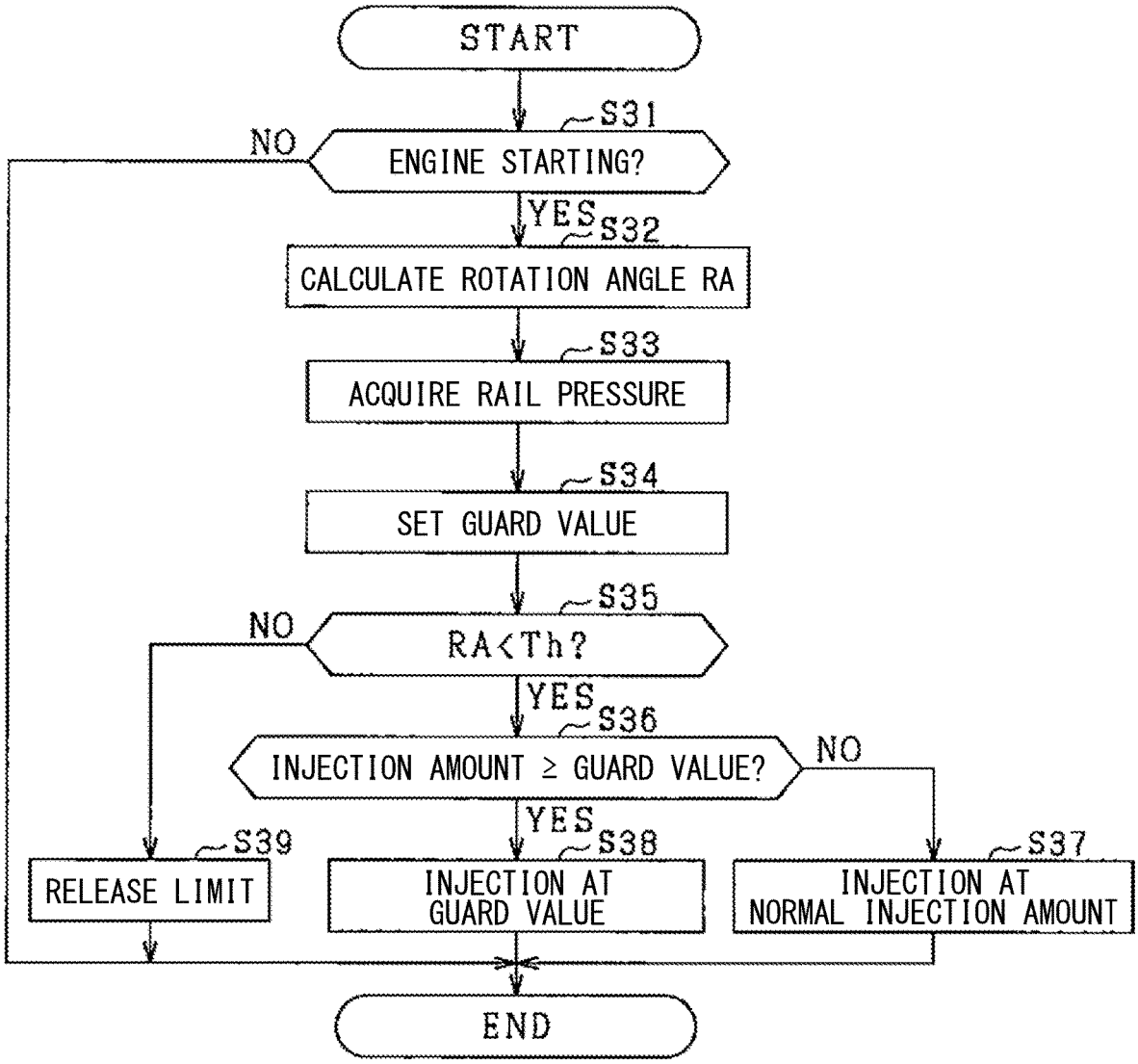
FIG. 13 is a flowchart showing an engine start control process in the third embodiment.

FIG. 13 is a flowchart showing an engine start control process. This process is repeatedly executed by the ECU 50 periodically while the ignition switch IG is turned on. In FIG. 13, the calculation process of the rotation angle RA of the camshaft 31 (that is, the cam rotation angle from the start of rotation due to the restart of the engine) is omitted for brevity, but the same process as that in FIG. 5 described above may be performed.

In FIG. 13, in step S31, it is determined whether or not the engine is being started. If YES, the process proceeds to step S32. At step S32, based on the current crank position, the rotation angle RA of the camshaft 31 from the start of rotation due to the engine restart is calculated. In step S33, the rail pressure of the fuel pump 13 is obtained for each fuel discharge, and in step S34, an injection amount guard value is set based on the rail pressure. Here, the relationship between rail pressure and guard value is set such that as the rail pressure increases, the injection amount guard value decreases.

Next, in step S35, it is determined whether or not the rotation angle RA of the camshaft 31 is less than a predetermined value Th. The predetermined value Th is a threshold value for determining a rotation angle required for forming an oil film between the shoe 43 and the roller 45 after the rotation of the camshaft 31 is started as described above. If the rotation angle RA is less than the predetermined value Th, the process proceeds to step S36. In step S36, it is determined whether or not the fuel injection amount for the next fuel injection is equal to or more than the injection amount guard value.

If the fuel injection amount is less than the injection amount guard value, the process proceeds to step S37, and the fuel injection is performed at the normal injection amount. Further, if the fuel injection amount is equal to or more than the injection amount guard value, the process proceeds to step S38, where the fuel injection amount is limited by the injection amount guard value. As a result, the fuel injection is performed at the injection amount guard value.

If the rotation angle RA is less than the predetermined value Th in step S35, the process proceeds to step S39. In step S39, if the fuel injection amount is limited by the injection amount guard value, the limit is released.

According to the present embodiment, at the time of starting the engine, it is possible to prevent the rotation speed of the camshaft 31 from excessively increasing to a level at which the risk of damage is high before the oil film is formed on the sliding portion of the tappet 41.

Figure 14:
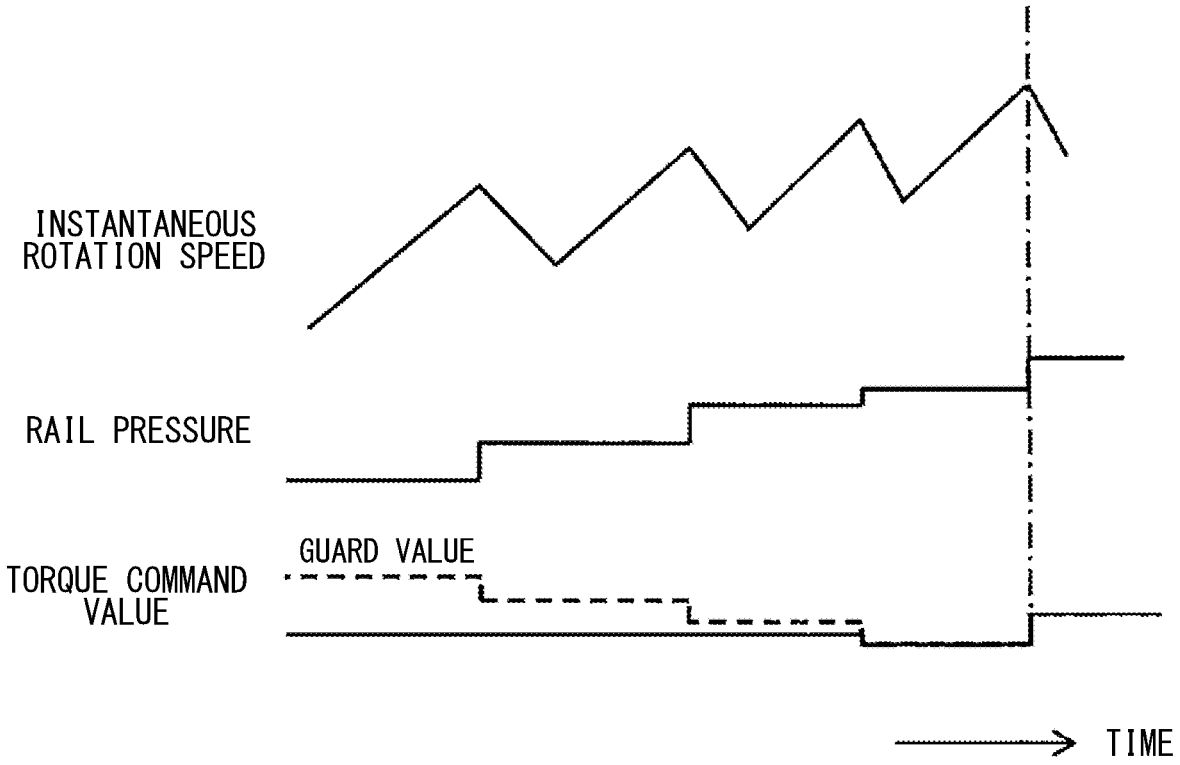
FIG. 14 is a time chart showing an engine start control in the third embodiment.

As another example of the present embodiment, the embodiment shown in FIG. 14 is also contemplated. In FIG. 14, similarly to FIG. 12, after the start of the engine 20, the fuel is injected from the injector 22 at predetermined intervals, and the resulting combustions cause the instantaneous engine speed to change while repeatedly increasing and decreasing. In FIG. 14, when the engine is started, the rotating electric machine 62 is driven with a predetermined torque command value.

In this case, as in the case of FIG. 12, as the rail pressure increases, the PV value approaches the limit value. Therefore, the ECU 50 sets a torque guard value as a V limit value (rotation speed limit value) according to the rail pressure for each fuel discharge of the fuel pump 13. The torque guard value acts as an upper limit guard on the torque command for the rotating electric machine 62.

The rotating electric machine 62 may have a configuration including a speed reducer. In this case, the ECU 50 may change the speed ratio (e.g., gear ratio) of the speed reducer based on the change in the torque command value as a gear change control.

Fourth Embodiment

In the present embodiment, at the time of starting the engine, it is determined whether the engine is being started by the starter motor 61 or by the rotating electric machine 62. Then, based on this determination, the PV limit process is changed. Note that the starter motor 61 may be referred to as a "first motor", and the rotating electric machine 62 may be referred to as a "second motor having an initial rotation speed higher than that of the first motor".

Figure 15:
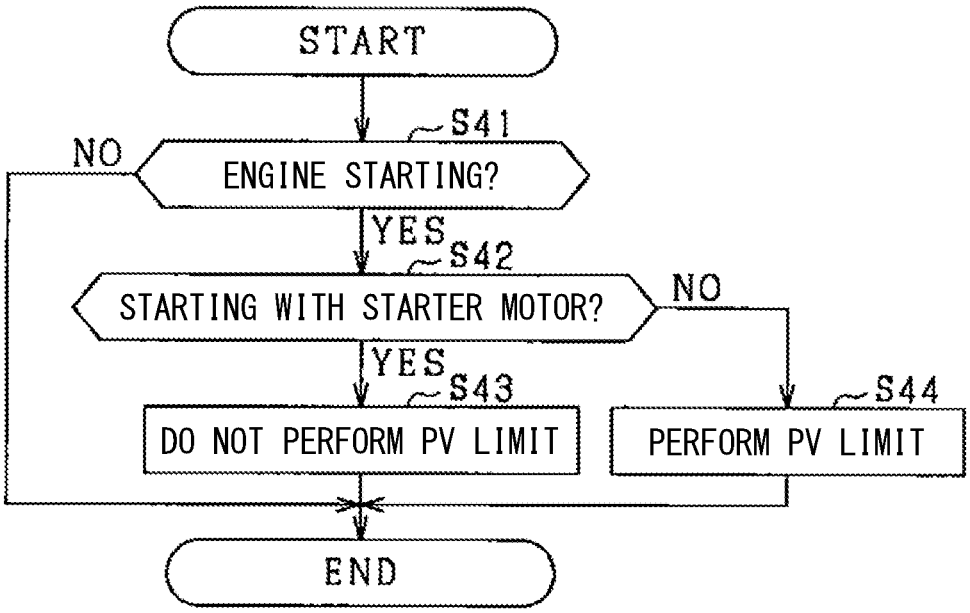
FIG. 15 is a flowchart showing an engine start control process in a fourth embodiment.

FIG. 15 is a flowchart showing an engine start control process of the present embodiment. This process is repeatedly executed by the ECU 50 periodically while the ignition switch IG is turned on. In FIG. 15, the calculation process of the rotation angle RA of the camshaft 31 (that is, the cam rotation angle from the start of rotation due to the restart of the engine) is omitted for brevity, but the same process as that in FIG. 5 described above may be performed.

In FIG. 15, in step S41, it is determined whether or not the engine is being started. If YES, the process proceeds to step S42. In step S42, it is determined whether or not the current engine start is performed by the starter motor 61. If the engine is being started by the starter motor 61, the process proceeds to step S43, and if the engine is being started by the rotating electric machine 62, the process proceeds to step S44. In the present embodiment, the starter motor 61 is used when the engine 20 is started for the first time, and the rotating electric machine 62 is used when the engine 20 is restarted during idling stop control. In this regard, step S42 will result in YES when starting the engine 20 for the first time, and result in NO when restarting the engine 20 from idling stop control.

In step S43, the engine start control is performed without executing a PV limit process, which includes at least one of the restriction of the fuel discharge pressure of the fuel pump 13 and the restriction of the rotation speed of the camshaft 31. In contrast, in step S44, a PV limit process, which includes at least one of the restriction of the fuel discharge pressure of the fuel pump 13 and the restriction of the rotation speed of the camshaft 31, is performed. Since the PV limit process has already been described, the description is omitted here.

Here, the starter motor 61 and the rotating electric machine 62 have different initial rotational speeds as each other. When the starter motor 61 starts the engine 20, the PV value, which is the product of the fuel discharge pressure corresponding to the load on the tappet 41 and the pump rotation speed, is relatively small. In contrast, when the rotating electric machine 62 starts the engine 20, it is considered that the PV value is generally higher. According to the present embodiment, it is possible to restrict excessively high values with respect to the fuel discharge of the fuel pump 13 and the rotation of the camshaft 31 by considering whether the engine is started by the starter motor 61 or whether the engine is started by the rotating electric machine 62.

Other Embodiments

The above-mentioned embodiments may be modified as described below:

When determining the rotation angle required for forming the oil film on the sliding portion of the tappet 41 at the time of starting the engine, the predetermined value Th used for the determination may be set as a value within the range from "0.5×360 degrees/n" to "2×360 degrees/n". In other words, the predetermined value Th is not necessarily limit to being "1.5×360 degrees/n" as described above. Note that n is the number of the cam ridges 32*a*. For example, in the case of a double cam, the predetermined value Th may be any angle within the range of 90 to 360 degrees. In the case of a triple cam, the predetermined value Th may be any angle within the range of 60 to 240 degrees.

In addition to the above, the predetermined value Th may be an angle defined in a range from "0.5×360 degrees/n" to "1.5×360 degrees/n". In this case, for a double cam, the predetermined value Th may be an angle within the range of 90 to 270 degrees, and for a triple cam, the predetermined value Th may be an angle within the range of 60 to 180 degrees. Alternatively, the predetermined value Th may be an angle defined in a range from "0.5×360 degrees/n" to "360 degrees/n". In this case, for a double cam, the predetermined value Th may be an angle within the range of 90 to 180 degrees, and for a triple cam, the predetermined value Th may be an angle within the range of 60 to 120 degrees.

Application to hybrid vehicles is also possible. A hybrid vehicle includes an engine and a rotating electric machine as propulsion power sources of the vehicle. The hybrid vehicle may travel using engine power (engine running), travel using rotating electric machine power (EV running), as well as travel using both engine power and rotating electric machine power (HV running). Further, the engine can be started by the rotating electric machine. In the present vehicle, during EV running, a residual pressure retention control process for maintaining the rail pressure in a high pressure state in preparation for the next engine running or HV running is performed. The engine is started while the residual pressure is maintained. In this case, the above-described PV limit process may be performed at the time of engine start accompanying the transition from EV running to engine running or HV running.

Application is also possible to a vehicle having only the starter motor 61 as the engine starting device. In this case, when the engine is restarted in the idling stop control, the engine 20 is restarted by the starter motor 61. Also in this configuration, it is preferable that the above-described PV limit process is performed at the time of engine start.

In the fuel pump 13, the tappet 41 may have a configuration other than the configuration using the shoe 43 and the roller 45. For example, a configuration in which the roller 45 is not provided at a contact portion with the cam 32 may be employed. Even in the present configuration, the fuel pump 13 uses the fuel pump 13 under the condition that the rotation angle RA from the start of rotation of the camshaft 31 at the time of engine start is less than a predetermined angle required for forming an oil film on a sliding portion of the tappet 41. By limiting the discharge pressure and the rotation of the camshaft 31, desired effects can be obtained. The predetermined value Th used to determine the time required for forming the oil film on the tappet 41 is determined in the range of "0.5×360 degrees/n" to "2×360 degrees/n", or a predetermined angle defined as "1.5×360 degrees/n" in the same manner as described above.

In the above embodiment, the rotation angle RA of the camshaft 31 from the start of rotation accompanying the engine start is calculated based on the detection information of the crank angle sensor 51, but this may be changed as appropriate. In the common rail 15, the fuel pressure fluctuates every time the fuel pump 13 discharges fuel or when the injector 22 injects fuel. Therefore, the rotation angle RA of the camshaft 31 from the start of rotation may be estimated based on information on these pressure fluctuations.

Further, the rotation angle RA of the camshaft 31 may be calculated based on a detection signal of a cam angle sensor provided on an engine camshaft that opens and closes an intake valve or an exhaust valve in the engine 20. Further, a rotation sensor may be provided on the camshaft 31 of the fuel pump 13, and the rotation angle RA of the camshaft 31 may be calculated based on a detection signal of the rotation sensor.

When estimating the rotation angle RA of the camshaft 31 based on pressure fluctuation information, not only the pressure fluctuations in the common rail 15 but also the pressure fluctuations in the fuel passage in the injector 22 and the fuel fluctuations in the fuel passage in the fuel pump 13 may be used to estimate the rotation angle RA of the camshaft 31. In short, any information that correlates with the rotation of the fuel pump 13 can be used as desired.

As a aspect for reducing the fuel pressure of the common rail 15, a aspect other than the pressure reduction valve 17 provided on the common rail 15 can be used. For example, the high pressure fuel in the common rail 15 can be released by the fuel injection of the injector 22, or the high pressure fuel in the common rail 15 can be released using a fuel discharge valve provided in the fuel pump 13.

In addition to a common rail diesel engine, the present disclosure can be applied to a direct injection gasoline engine.

The above plurality embodiments of the present disclosure provide a controller for a fuel injection system that can appropriately reduce the occurrence of damage to a fuel pump when starting an internal combustion engine while still ensuring fast responsivity in engine start.

For example, consider a comparative example technique in which when an internal combustion engine is to be restarted from a state in which the internal combustion engine was automatically stopped by idling stop control, if the pressure in the common rail (rail pressure) detected by a rail pressure detection unit is equal to or more than a predetermined first threshold value, a flow control valve is closed when the internal combustion engine is restarted, and once the rail pressure has decreased to a second threshold value due to fuel injection, the flow control valve is opened. As a result, the operation of the fuel pump is started after the oil film is formed on the sliding portions of the fuel pump, so that the durability of the fuel pump is prevented from being reduced.

However, in the technique of the above comparative example technique, after the internal combustion engine is restarted, the flow control valve is kept closed until the rail pressure detected by the rail pressure detection unit falls below the second threshold. Due to the delay in starting the operation of the fuel pump, there are concerns that the startability of the internal combustion engine may be reduced or that the drivability of the vehicle may be reduced. For example, if a request for rapid acceleration of the vehicle occurs immediately after the restart of the internal combustion engine, there is a concern that the desired engine torque cannot be obtained due to the stoppage of the operation of the fuel pump.

In addition, if the above comparative example technique also uses a rotating electric machine to apply an initial rotation speed higher than that of a starter motor to the internal combustion engine as a starting device for the internal combustion engine, in this case as compared to a starter motor driven at a predetermined cranking rotation speed, the initial rotation speed when starting the internal combustion engine is high and the rotation speed increases at a high rate. As a result, even if the rail pressure is not high (for example, even if the rail pressure is equal to or less than the first threshold value in the comparative example technique), there is a concern that galling or seizure may occur at the sliding portion of the fuel pump.

For addressing the above concerns, at least the following aspects are contemplated in the present disclosure.

As a first aspect, a controller is applied to a fuel injection system including a fuel pump having a camshaft that rotates in accordance with operation of an internal combustion engine, a tappet provided in contact with a cam of the camshaft that converts the rotation of the camshaft into linear motion, and a plunger that reciprocates according to the linear motion of the tappet, the fuel pump being configured to suck and discharge fuel according to the reciprocation of the plunger, an accumulator that stores high pressure fuel discharged from the fuel pump, and a fuel injection valve that injects the high pressure fuel stored in the accumulator into a combustion chamber of the internal combustion engine, the controller including an angle determination unit configured to determine whether a rotation angle from a start of rotation of the camshaft when starting the internal combustion engine is under a predetermined angle required for forming an oil film on a sliding portion of the tappet, and a control unit configured to: when the rotation angle from the start of rotation of the camshaft is determined to be under the predetermined angle, execute a limit process including at least one of limiting a fuel discharge pressure of the fuel pump or limiting a rotation of the camshaft, and when the rotation angle is determined to have exceeded the predetermined angle after having executed the limit process, cancel the limit process execution.

In a fuel pump having a tappet as a plunger drive mechanism, when starting the internal combustion engine, it is desirable that the drive of the fuel pump be started as soon as possible while an oil film is formed on the sliding portion of the tappet. In this regard, after the start of rotation of the camshaft accompanying the start of the internal combustion engine, it is considered that the state of formation of an oil film on the sliding portion of the tappet can be ascertained from information related to the rotation angle of the camshaft from the start of rotation. Further, factors that cause seizure in the sliding portion of the tappet include a load transmitted to the tappet via the plunger at the time of fuel discharge and a rate of increase in the rotation speed of the camshaft. The possibility of seizure increases depending on the product of the discharge pressure (P) and the pump rotation speed (V) corresponding to the rate of increase of the rotation speed of the camshaft when the internal combustion engine is being started. In other words, the magnitude of the PV value is considered.

Considering these points, according to the controller with the above described configuration, an angle determination unit is configured to determine whether a rotation angle from a start of rotation of the camshaft when starting the internal combustion engine is under a predetermined angle required for forming an oil film on a sliding portion of the tappet. Then, the control unit is configured to, when the rotation angle from the start of rotation of the camshaft is determined to be under the predetermined angle, execute a limit process including at least one of limiting a fuel discharge pressure of the fuel pump or limiting a rotation of the camshaft, and when the rotation angle is determined to have exceeded the predetermined angle after having executed the limit process, cancel the limit process execution.

In this case, by using the rotation angle of the camshaft when beginning to rotate during the start of the internal combustion engine start as a parameter, the state of formation of an oil film on the sliding portion of the tappet can be properly assessed. In addition, under the condition that the rotation angle from the start of rotation of the camshaft is less than the predetermined angle, at least one of limiting the fuel discharge pressure of the fuel pump and limiting the rotation of the camshaft is performed. When the angle exceeds the predetermined angle, the limit is canceled. Accordingly, the fuel pump can restrict the fuel discharge pressure and the rotation of the camshaft in an appropriate period, thereby avoiding unnecessary delays in the start of driving of the fuel pump. As a result, it is possible to appropriately prevent the occurrence of damage to the fuel pump at the time of starting the internal combustion engine.

As a second aspect, according to the first aspect, the control unit is configured to: limit the fuel discharge pressure of the fuel pump by performing any one of: stopping the fuel discharge of the fuel pump, decreasing a fuel discharge amount of the fuel pump, and discharging the fuel in the accumulator to reduce fuel pressure, and limit the rotation of the camshaft by performing any one of: stopping the fuel injection of the fuel injection valve, reducing a fuel injection amount of the fuel injection valve, and limiting a rotation of a starter device that applies an initial rotation to the internal combustion engine when starting the internal combustion engine.

According to the above configuration, in order to limit the fuel discharge pressure of the fuel pump, any one of a process of stopping the fuel discharge of the fuel pump, a process of reducing the fuel discharge amount of the fuel pump, and a process of discharging the fuel in the accumulator to reduce the fuel pressure is performed. By performing any one of the processes described above, the fuel discharge pressure (P) corresponding to the load on the tappet can be appropriately reduced when the internal combustion engine is started. Further, reducing the fuel discharge amount of the fuel pump includes a process of lowering the control target value of the fuel pressure in the accumulator and a process of reducing the fuel discharge amount calculated in a normal process and then performing fuel discharge with the reduced fuel discharge amount.

Further, limiting the rotation of the camshaft includes performing one of a process of stopping the fuel injection of the fuel injection valve or reducing the fuel injection amount and a process of restricting the rotation of the starting device, at the time of starting the internal combustion engine. As a result, the pump rotation speed (V) can be appropriately reduced. As a result, the PV value is reduced, and damage to the fuel pump can be properly prevented.

In recent years, a rotating electric machine capable of rotating at a higher speed than a cranking rotational speed (for example, 200 rpm) of a starter motor may be used as a starting device, and the internal combustion engine may be started by driving the rotating electric machine. In this case, the initial rotation applied to the internal combustion engine becomes faster, but by limiting the fuel discharge pressure of the fuel pump, the internal combustion engine can be started by the rotating electric machine during a state equivalent to the case where the oil film is not broken, that is, a state where there is no rotation restriction is maintained.

As a third aspect, according to the first aspect, a calculation unit is further provided and configured to, after initiating the starting of the internal combustion engine, calculate a rotation speed peak value for each combustion according to the fuel injection of the fuel injection valve, wherein the control unit limits the rotation of the camshaft based on the rotation speed peak value calculated by the calculation unit.

After initiating the starting of the internal combustion engine, when combustion occurs in response to the fuel injection of the fuel injection valve, the rotation speed (instantaneous rotation speed) changes while repeatedly increasing and decreasing for each combustion. In this case, the peak value of the instantaneous engine rotation speed increases as the number of combustions increases, and there is a concern that the risk of damage to the tappet due to seizure may occur with the increase in the peak value of the instantaneous engine rotation speed. Therefore, in the present embodiment, the peak value of the rotation speed is calculated every combustion, and the rotation of the camshaft is limited based on this rotation speed peak value. As a result, at the time of starting the internal combustion engine, it is possible to prevent the rotation speed of the camshaft from excessively increasing to a level at which the risk of damage is high before the oil film is formed on the sliding portion of the tappet.

As a fourth aspect, according to the first aspect, a pressure acquisition unit is further provided and configured to, after initiating the starting of the internal combustion engine, acquire the fuel pressure in the accumulator for each fuel discharge of the fuel pump, wherein the control unit limits the rotation of the camshaft based on the fuel pressure acquired by the pressure acquisition unit.

After initiating the starting of the internal combustion engine, when the fuel is discharged from the fuel pump in accordance with the operation of the internal combustion engine, the fuel pressure in the accumulator gradually increases. In this regard, in the above configuration, the fuel pressure of the accumulator is obtained for each fuel discharge of the fuel pump, and the rotation of the camshaft is limited based on the fuel pressure. As a result, at the time of starting the internal combustion engine, it is possible to prevent the rotation speed of the camshaft from excessively increasing to a level at which the risk of damage is high before the oil film is formed on the sliding portion of the tappet.

As a fifth aspect, according to any one of the first to fourth aspect, the cam has n (n being an integer of 1 or more) cam ridges, the tappet includes a roller that abuts on a cam surface of the cam, and a shoe having a concave portion for accommodating the roller and rotatably supporting the roller in the concave portion, wherein the angle determination unit is configured to determine whether or not the rotation angle of the camshaft from the start of rotation is under a predetermined angle defined within a range of "0.5×360 degrees/n" to "2×360 degrees/n".

In a configuration in which the tappet has a roller that comes into contact with the cam surface of the cam and a shoe that has a recess for accommodating the roller, and the roller slides inside the recess of the shoe, when first starting the internal combustion engine, i.e., when the camshaft first begins to rotate, an oil film is formed between the shoe and the roller during a period between the cam rotates from a top rotation position to a bottom rotation position and back to the top rotation position. In other words, even when the oil film is broken between the shoe and the roller, when the cam passes through the bottom rotation position, the oil film is formed between the shoe and the roller due to the squeeze film effect (also called the squeeze effect).

In this case, the period during which the cam rotates from "top rotation position to bottom rotation position to top rotation position" is the period during which the camshaft rotates at an angle of "360 degrees/n", where n is the number of cam ridges. Further, in the stopped state of the internal combustion engine (fuel pump), the stop position of the cam varies, and for example, the stop position of the cam may be a position slightly beyond the top rotation position. Therefore, considering variations in the cam stop position, the rotation angle of the camshaft required for forming the oil film between the shoe and the roller is considered to be approximately "2×360 degrees/n" as a maximum possible value.

Also, considering that the oil film is formed by the squeeze film effect when the cam passes through the bottom rotation position, the rotation angle required for the oil film formation is less than a predetermined angle including the angles in front of and behind the bottom rotation position of the cam. This period is a period during which the cam rotates from "an intermediate position between the top position and the bottom position to the bottom rotation position to the intermediate position between the top position and the bottom position". That is, the period may be a period in which the camshaft rotates at least by an angle of "0.5×360 degrees/n" when the number of cam ridges is n.

On this point, according to the above described configuration, it is determined whether or not the rotation angle of the camshaft from the start of rotation is less than a predetermined angle range between "0.5×360 degrees/n" and "2×360 degrees/n". As a result, it is possible to determine whether the camshaft has been rotated by an angle required for forming the oil film on the sliding portion of the tappet. Accordingly, appropriate control can be performed when during the start of the internal combustion engine, while taking into account the oil film formation mechanism of the tappet structure having the shoe and the roller.

The rotation angle of the camshaft required for forming the oil film on the sliding portion of the tappet may be determined to be any angle within the range from "0.5×360 degrees/n" to "2×360 degrees/n". This rotation angle may be, for example, an angle in a range from "0.5×360 degrees/n" to "1.5×360 degrees/n", or an angle in a range from "0.5×360 degrees/n" to "360 degrees/n".

As a sixth aspect, according to any one of the first to fourth aspect, the cam has n (n being an integer of 1 or more) cam ridges, the tappet includes a roller that abuts on a cam surface of the cam, and a shoe having a concave portion for accommodating the roller and rotatably supporting the roller in the concave portion, wherein the angle determination unit is configured to determine whether or not the rotation angle of the camshaft from the start of rotation is under a predetermined angle defined as "1.5×360 degrees/n".

In the stopped state of the internal combustion engine (fuel pump), the cam may be stopped at or near the bottom rotation position. When considering this, the rotation angle of the camshaft required for forming the oil film between the shoe and the roller is considered to be approximately "1.5×360 degrees/n" as a maximum possible value. On this point, according to the above described configuration, it is determined whether or not the rotation angle of the camshaft from the start of rotation is less than a predetermined angle defined as "1.5×360 degrees/n". As a result, it is possible to determine whether the camshaft has been rotated by an angle required for forming the oil film on the sliding portion of the tappet. Accordingly, appropriate control can be performed when during the start of the internal combustion engine, while taking into account the oil film formation mechanism of the tappet structure having the shoe and the roller.

As a seventh aspect, according to any one of the first to sixth aspect, the fuel injection system is applied to a vehicle having, as starter devices for the internal combustion engine, a first motor and a second motor having an initial rotation speed higher than that of the first motor, the controller further including a start determination unit configured to, when the internal combustion engine is being started, determine whether the engine is being started by the first motor or started by the second motor, and a second control unit configured to prohibit the limit process from being executed when the engine is being started by the first motor, and to permit the limit process from being executed when the engine is being started by the second motor.

For example, in a vehicle having an idling stop function, a first motor (for example, a starter motor) as a starting device used for the first start of the internal combustion engine, and a second motor (which is a rotating electric machine such as an ISG) for restarting the internal combustion engine after an automatic stop may be provided. The second motor is a motor having an initial rotation speed higher than that of the first motor. In this case, when starting using the first motor, the PV value, which is the product of the fuel discharge pressure corresponding to the load on the tappet and the pump rotation speed, becomes relatively small, whereas when starting using the second motor, the PV value is greater.

In this regard, in the above configuration, when the first motor is used to start the internal combustion engine, the limiting of the fuel discharge pressure of the fuel pump and the limiting of the rotation of the camshaft are not performed. In contrast, if the second motor is used to start the internal combustion engine, at least one of limiting the fuel discharge pressure of the fuel pump and limiting the rotation of the camshaft is performed. In this case, it is possible to avoid excessively limiting the fuel discharge of the fuel pump and the rotation of the camshaft.

The controller and the method described in the present disclosure may be implemented by a special purpose computer which is configured with a memory and a processor programmed to execute one or more particular functions embodied in computer programs of the memory. Alternatively, the controller and the method described in the present disclosure may be implemented by a special purpose computer configured as a processor with one or more special purpose hardware logic circuits. Alternatively, the controller and the method described in the present disclosure may be implemented by one or more special purpose computer, which is configured as a combination of a processor and a memory, which are programmed to perform one or more functions, and a processor which is configured with one or more hardware logic circuits. The computer programs may be stored, as instructions to be executed by a computer, in a tangible non-transitory computer-readable medium.

The invention claimed is:

1. A controller for a fuel injection system including a fuel pump having a camshaft that rotates in accordance with operation of an internal combustion engine, a tappet provided in contact with a cam of the camshaft that converts the rotation of the camshaft into linear motion, and a plunger that reciprocates according to the linear motion of the tappet, the fuel pump being configured to suck and discharge fuel according to the reciprocation of the plunger, an accumulator that stores high pressure fuel discharged from the fuel pump, and a fuel injection valve that injects the high pressure fuel stored in the accumulator into a combustion chamber of the internal combustion engine, the controller comprising:

an angle determination unit configured to determine whether a rotation angle from a start of rotation of the camshaft when starting the internal combustion engine is under a predetermined angle required for forming an oil film on a sliding portion of the tappet, and a control unit configured to:

when the rotation angle from the start of rotation of the camshaft is determined to be under the predetermined angle, execute a limit process including at least one of limiting a fuel discharge pressure of the fuel pump or limiting a rotation of the camshaft, and when the rotation angle is determined to have exceeded the predetermined angle after having executed the limit process, cancel the limit process execution.

2. The controller for the fuel injection system according to claim 1, wherein the control unit is configured to:

limit the fuel discharge pressure of the fuel pump by performing any one of: stopping the fuel discharge of the fuel pump, decreasing a fuel discharge amount of the fuel pump, and discharging the fuel in the accumulator to reduce fuel pressure, and limit the rotation of the camshaft by performing any one of: stopping the fuel injection of the fuel injection valve, reducing a fuel injection amount of the fuel injection valve, and limiting a rotation of a starter device that applies an initial rotation to the internal combustion engine when starting the internal combustion engine.

3. The controller for the fuel injection system according to claim 1, further comprising:

a calculation unit configured to, after initiating the starting of the internal combustion engine, calculate a rotation speed peak value for each combustion according to the fuel injection of the fuel injection valve, wherein the control unit limits the rotation of the camshaft based on the rotation speed peak value calculated by the calculation unit.

4. The controller for the fuel injection system according to claim 1, further comprising:

a pressure acquisition unit configured to, after initiating the starting of the internal combustion engine, acquire the fuel pressure in the accumulator for each fuel discharge of the fuel pump, wherein the control unit limits the rotation of the camshaft based on the fuel pressure acquired by the pressure acquisition unit.

5. The controller for the fuel injection system according to claim 1, wherein the cam has n cam ridges, the tappet includes a roller that abuts on a cam surface of the cam, and a shoe having a concave portion for accommodating the roller and rotatably supporting the roller in the concave portion, wherein the angle determination unit is configured to determine whether or not the rotation angle of the camshaft from the start of rotation is under a predetermined angle defined within a range of "0.5×360 degrees/n" to "2×360 degrees/n".

6. The controller for the fuel injection system according to claim 1, wherein the cam has n cam ridges, the tappet includes a roller that abuts on a cam surface of the cam, and a shoe having a concave portion for accommodating the roller and rotatably supporting the roller in the concave portion, wherein the angle determination unit is configured to determine whether or not the rotation angle of the camshaft from the start of rotation is under a predetermined angle defined as "1.5×360 degrees/n".

7. The controller for the fuel injection system according to claim 1, wherein the fuel injection system is applied to a vehicle having, as starter devices for the internal combustion engine, a first motor and a second motor having an initial rotation speed higher than that of the first motor, the controller further comprising:

a start determination unit configured to, when the internal combustion engine is being started, determine whether the engine is being started by the first motor or started by the second motor, and a second control unit configured to prohibit the limit process from being executed when the engine is being started by the first motor, and to permit the limit process from being executed when the engine is being started by the second motor.

8. A fuel injection system for an internal combustion engine, comprising:

a fuel pump including:

a camshaft that rotates in accordance with operation of the internal combustion engine, a tappet provided in contact with a cam of the camshaft that converts the rotation of the camshaft into linear motion, and a plunger that reciprocates according to the linear motion of the tappet, the fuel pump being configured to suck and discharge fuel according to the reciprocation of the plunger;

an accumulator that stores the fuel discharged from the fuel pump;

a fuel injection valve that injects the fuel stored in the accumulator into a combustion chamber of the internal combustion engine; and an electronic control unit including a processor and a memory, the memory having stored thereon instructions which when executed by the processor causes the processor to:

determine whether a rotation angle from a start of rotation of the camshaft when starting the internal combustion engine is under a predetermined angle required for forming an oil film on a sliding portion of the tappet, upon determining that the rotation angle from the start of rotation of the camshaft is under the predetermined angle, execute a limit process including at least one of limiting a fuel discharge pressure of the fuel pump or limiting a rotation of the camshaft, and upon determining that the rotation angle is greater than the predetermined angle after having executed the limit process, cancel the limit process execution.

* * * * *